US011421959B2

(12) United States Patent
Evans et al.

(10) Patent No.: US 11,421,959 B2
(45) Date of Patent: Aug. 23, 2022

(54) FIREARM HOLSTER

(71) Applicant: Edge-Works Manufacturing Company, Burgaw, NC (US)

(72) Inventors: Scott V. Evans, Jacksonville, NC (US); Nicholas R. Tomczak, Richlands, NC (US)

(73) Assignee: Edge-Works Manufacturing Company, Burgaw, NC (US)

( * ) Notice: Subject to any disclaimer, the term of this patent is extended or adjusted under 35 U.S.C. 154(b) by 0 days.

(21) Appl. No.: 17/582,658

(22) Filed: Jan. 24, 2022

(65) Prior Publication Data

US 2022/0146229 A1 May 12, 2022

Related U.S. Application Data

(63) Continuation of application No. PCT/US2020/046585, filed on Aug. 16, 2020.
(Continued)

(51) Int. Cl.
*F41C 33/02* (2006.01)

(52) U.S. Cl.
CPC ..... *F41C 33/0263* (2013.01); *F41C 33/0209* (2013.01); *F41C 33/0227* (2013.01)

(58) Field of Classification Search
CPC .. F41C 33/02; F41C 33/0209; F41C 33/0236; F41C 33/0245; F41C 33/0254; F41C 33/0272; F41C 33/0281; F41C 33/0263
(Continued)

(56) References Cited

U.S. PATENT DOCUMENTS 3,550,822 A * 12/1970 Lloyd ..... F41C 33/0263 42/70.11
7,461,765 B2 * 12/2008 French ..... F41C 33/045 382/126

(Continued)

FOREIGN PATENT DOCUMENTS

EP 2784432 A1 * 10/2014 ..... F41C 33/0263
WO WO-2021034732 A1 * 2/2021 ..... F41C 33/0227

OTHER PUBLICATIONS

Copenheaver, Blaine R; International Search Report and Written Opinion of the International Search Authority (USPTO) for PCT/US2020/046585.

(Continued)

*Primary Examiner* — Justin M Larson
(74) *Attorney, Agent, or Firm* — Stephen M. Kepper; Mark N. Melasky; Intellectual Property Consulting, LLC

(57) ABSTRACT

A firearm holster for securely enclosing a firearm is provided. A spring biased triggering lever is pivotally secured to the holster. A slider attached to the firearm holster slides on the slider base from a locked position to an unlocked position upon pressing the triggering lever. A spring-biased resettable drop lock is pivotally connected to a resettable drop lock mount attached to the holster and extends into an ejection port of a firearm secured in the firearm holster. The resettable drop lock pivots out of the ejection port of the firearm in the firearm holster by contact with the slider as the slider moves from a locked position into an unlocked position. A secondary lock includes a helical lock shaft disposed within a secondary lock body and extends from the lock body to rotate a secondary lock from a locked position to an unlocked position.

18 Claims, 33 Drawing Sheets

Related U.S. Application Data

(60) Provisional application No. 62/888,155, filed on Aug. 16, 2019.

(58) Field of Classification Search
USPC ..... 224/243, 244
See application file for complete search history.

(56) References Cited

U.S. PATENT DOCUMENTS

| | | | | |
|---|---|---|---|---|
| 7,562,797 | B2 * | 7/2009 | Senn | F41C 33/0263 224/198 |
| 7,584,875 | B2 * | 9/2009 | Lowe | F41C 33/0236 224/912 |
| 8,052,018 | B2 * | 11/2011 | Gallagher | F41C 33/0263 224/243 |
| 8,141,758 | B2 * | 3/2012 | Spielberger | F41C 33/0263 224/238 |
| 8,177,108 | B1 * | 5/2012 | Kincaid | F41C 33/0209 224/193 |
| 8,602,276 | B2 * | 12/2013 | Tyybakinoja | F41C 33/0263 224/198 |
| 8,870,042 | B2 * | 10/2014 | Clifton | A45F 5/021 224/198 |
| 8,925,773 | B2 * | 1/2015 | Clifton | F41C 33/0209 224/198 |
| 9,022,262 | B2 * | 5/2015 | Pellegrini | F41C 33/0227 224/912 |
| 9,175,925 | B2 * | 11/2015 | Pellegrini | F41C 33/0227 |
| 10,458,748 | B2 * | 10/2019 | Yeates | F41C 33/0272 |
| 10,634,452 | B1 * | 4/2020 | Chester | F41C 33/0263 |
| 11,054,214 | B2 * | 7/2021 | Pellegrini | F41C 33/0263 |
| 2007/0181619 | A1 * | 8/2007 | Seyfert | F41C 33/0227 224/912 |
| 2009/0223104 | A1 | 9/2009 | Anzeloni | |
| 2011/0163138 | A1 | 7/2011 | Tyybakinoja | |
| 2014/0048573 | A1 | 2/2014 | Pellegrini et al. | |
| 2020/0292272 | A1 * | 9/2020 | Treto | F41C 33/0209 |
| 2020/0408488 | A1 * | 12/2020 | Pellegrini | F41C 33/0263 |

OTHER PUBLICATIONS

Demand for International Preliminary Examination, including Remarks and Art. 34 Amendments.

Larson, Justing Matthew; Written Opinion of the International Preliminary Examining Authority (USPTO) for PCT/US2020/046585.

* cited by examiner

FIREARM HOLSTER

CROSS REFERENCE TO RELATED APPLICATIONS

This application is a continuation to PCT/US2020/046585, filed Aug. 16, 2020, which claims priority to U.S. Provisional Patent Application No. 62/888,155, filed Aug. 16, 2019, the entirety of which is incorporated by reference as if fully disclosed herein.

BACKGROUND OF THE INVENTION

Filed of the Invention

The present invention relates generally to holsters for handguns having a retention mechanism associated therewith for preventing unauthorized withdrawal of the weapon from the holster and, more particularly, to an improved retention mechanism which allows for rapid deployment of the weapon from the holster pocket by the user when desired, but prevents unauthorized, accidental or inadvertent removal of the weapon from the holster.

General Background

Inadvertent, accidental, and even unauthorized removal of a weapon from a holster is a common problem faced by law enforcement personnel, military personnel and other tactical users of holstered weapons. To be effective, a holster must address two major concerns, namely, (1) security of the weapon at all times, and (2) allowing the authorized user access and means for the rapid deployment of the weapon when desired. There is therefore a need for effectively carrying a weapon in a holster and for rapidly deploying such weapon when needed. There is also a need to effectively prevent accidental, inadvertent, or unauthorized withdrawal of the weapon from a holster such as when the authorized user is running, maneuvering, or otherwise engaging the enemy or an assailant.

The prior art discloses a wide variety of different mechanisms to prevent inadvertent withdrawal of a weapon from a holster. Prior art constructions for the most part are characterized by complicated and cumbersome mechanisms which are inconvenient, awkward and difficult to manipulate and operate to achieve rapid deployment of the weapon from the holster, and such mechanisms can suffer from substantial wear and tear during use. Although such security devices and mechanisms are desired in all types of holsters, including belt carried holsters, shoulder holsters, competition holsters and others, to reduce the risk of unauthorized, inadvertent, or accidental removal of the weapon from the holster, mechanisms which ensure higher security of the weapon within the holster pocket typically lead to a slower draw or slower deployment of the weapon whereas mechanisms which afford rapid deployment of the weapon typically lead to a lesser amount of security for the holstered weapon. As such, the user is often left with an undesirable trade-off between the two necessary features, namely, security versus rapid deployment. Recognizing that the weapon is the implement of last resort and immediate need for an authorized user, use of a weapon retention mechanism which affords both high security and rapid deployment, and which does not compromise either necessary feature, is highly desirable.

Thus, there is a need for weapon retention mechanism for holsters which both effectively incorporate high security weapon retention features in a holster without inhibiting the speed with which a user may deploy the weapon. As a result, the present invention is directed to a holster retention mechanism which overcomes one or more of the problems set forth above and represents an improvement over the known prior art weapon retention mechanisms.

SUMMARY OF THE INVENTION

In accordance with one embodiment, firearm holster for securely enclosing a firearm is provided. The firearm holster includes a top frame defining a slider base recess. The top frame defines a resettable drop lock passage. A slider base is disposed in the slider base recess of the top frame and is operable to receive and slidably engage a slider. The slider base defines a resettable drop lock mount. The firearm holster includes a lower body and is secured to the top frame via a backbone securing the top frame to the lower body. A triggering lever mount is defined by the backbone. A triggering lever is pivotally secured to the triggering lever mount and has a triggering arm and an actuating arm. The triggering lever defines a spring channel. A triggering lever spring is disposed within the spring channel and is operable to spring-bias the triggering lever in locked the position. A slider is operable to slide on the slider base from a locked position to an unlocked position. An extension arm is connected to the slider and is operable to receive a force from the actuating arm of the triggering lever to slide the slider from a locked position to an unlocked position. A spring-biased automatic resettable drop lock is pivotally connected to the resettable drop lock mount and is operable to extend into the resettable drop lock passage and into an ejection port of a firearm secured in the firearm holster. The resettable drop lock is operable to be pivoted out of the ejection port of the firearm in the firearm holster by contact with the slider as the slider moves from a locked position into an unlocked position. The firearm holster includes a secondary lock assembly having a secondary lock body, a helical lock shaft disposed within the secondary lock body and operable to extend from the helical lock shaft passage, a sear lever pivotally attached to the secondary lock body and operable to retain the helical lock shaft in the secondary lock body, and a helical lock bar attached to the helical lock shaft. The helical lock bar is operable to rotate and extend from a locked position to an unlocked position.

In one embodiment of the invention, a top frame of a firearm holster is provided. The top frame includes a top frame body having a proximal end opposite a distal end and an upper portion opposite a lower portion. A slider base recess is defined by the upper portion of the body and is operable to receive and secure a slider base. A slider base is disposed within the slider base recess and is operable to receive and secure a slider. The slider base operable to enable a slider to selectively slide relative to the top frame body. In some embodiments, the slider is defined by and integral to the top frame. In some embodiments, a mount is operable to receive and secure a lock bar and operable to enable a resettable lock bar to pivot.

In one embodiment, a backbone is operable for use coupling a top frame of a firearm holster to a lower body of the firearm holster, comprising. A backbone body hays a proximal end opposite a distal end. A proximal frame coupler is disposed at the proximal end of the backbone body and is operable to couple to a top frame of a firearm holster and a lower body of a firearm holster. A distal frame coupler is disposed at the distal end of the backbone body and is operable to couple to a top frame of a firearm holster and a lower body of a firearm holster. In some embodiments, a triggering lever mount is attached to the backbone body and is operable to receive and secure a triggering lever. In some embodiments, a coupling mount is attached to the backbone body.

In accordance with embodiments of the invention, a triggering lever is provided. The triggering lever includes a triggering lever body defining a cylindrical passage operable to receive and rotate around a cylindrical shaft from a locked position to an unlocked position. A spring channel is defined by the triggering lever body and is operable to securely enclose a triggering lever spring. A spring end opening is defined by the triggering lever body. A triggering lever spring disposed within the spring channel of the triggering lever body and has a first end extending into the spring end opening of the triggering lever body. The spring operable to bias the triggering lever into a locked position. A triggering lever spring tension device is operable to secure to a trigger lever mount and defines a spring end opening. The triggering lever spring tension device is operable to adjust tension in the triggering lever spring by selectively rotating and coupling the triggering lever spring tension device relative to the thumb lever mount to contract or elongate the triggering lever spring. A coupler is defined by the triggering lever spring tension device and is operable to couple to a thumb lever mount. A triggering arm is attached to the triggering lever body and is operable to receive a force from a user counteracting the bias of the spring and rotate the triggering lever body in response to the force. A drive arm is attached to the triggering lever body and is operable to rotate a slider from a locked position to an unlocked position in response to the force from a user. In some embodiments, the triggering lever is oriented to enable a user to use an ergonomic thumb motion to press the triggering lever while the user grips the firearm holster in the perfect shooting grip.

In accordance with embodiments of the invention, a resettable drop lock is provided and is operable to retain a firearm in a firearm holster. The resettable drop lock includes a resettable drop lock body having a proximal end opposite a distal end and is operable to connect to a top frame of a firearm holster. The resettable drop lock body is operable to protrude into an ejection port of a firearm. A cylindrical passage defined by the resettable drop lock body is operable to receive and secure a shaft. The resettable drop lock body is operable to rotate about the shaft. A spring is operable to spring-bias and selectively pivot the resettable drop lock body through a resettable drop lock passage and into the ejection port of a firearm secured within a firearm holster.

In accordance with embodiments of the invention, a slider is provided. The slider is operable for securing a firearm in firearm holster. The slider includes a slider body and a slider base disposed on a firearm holster. A sliding surface is disposed on a bottom of the slider body and operable to enable the slider to slide between a locked position and an unlocked position along the slider base. In some embodiments, the slider is operable to selectively pivot a resettable drop lock into an ejection port of a firearm secured in a firearm holster to secure the firearm in the holster, and the slider is operable to selectively pivot a resettable drop lock out of the ejection port of a firearm secured in a firearm holster to enable removal of the firearm from the firearm holster.

In accordance with embodiments of the invention, a secondary lock assembly is operable to retain a firearm in a holster. The secondar lock assembly includes a secondary lock body defining a helical lock shaft passage. A sear lever channel is defined by the secondary lock body. A helical lock guide pin aperture is defined by the secondary lock body. The secondary lock body is operable for attachment to a firearm holster. A sear lever is pivotally attached to the secondary lock body and is operable to pivot from a locked position to an unlocked position. The sear lever is operable to engage and retain a helical lock bar. A secondary thumb pad is attached to the sear lever and is operable to receive a force from a user to pivot the sear lever. In some embodiments, the triggering lever is oriented to enable a user to use an ergonomic thumb motion to press the triggering lever while the user grips the firearm holster in the perfect shooting grip. A helical lock shaft is disposed within the helical lock shaft passage and defines a helical guide slot. The helical lock shaft is operable to rotate and extend from the helical lock shaft passage. A helical lock bar is attached to the helical lock shaft and is operable to rotate from a locked position to an unlocked position. A helical guide pin is disposed within the helical guide pin aperture and protrudes into the helical guide slot. The helical guide pin is operable to retain the helical lock bar in the helical lock shaft passage. A helical lock spring is disposed between the secondary lock body and the helical lock shaft and is operable to apply a force to the helical lock shaft to bias the helical lock shaft into an unlocked position. A helical sear lever spring disposed between the secondary lock body and the sear lever and is operable to apply a force to the sear lever to bias the sear lever into a locked position.

BRIEF DESCRIPTION OF THE DRAWINGS

The foregoing and other objects, features, and advantages of the invention are apparent from the following detailed description taken in conjunction with the accompanying drawings in which like parts are given like reference numerals and, wherein.

Figure 1:
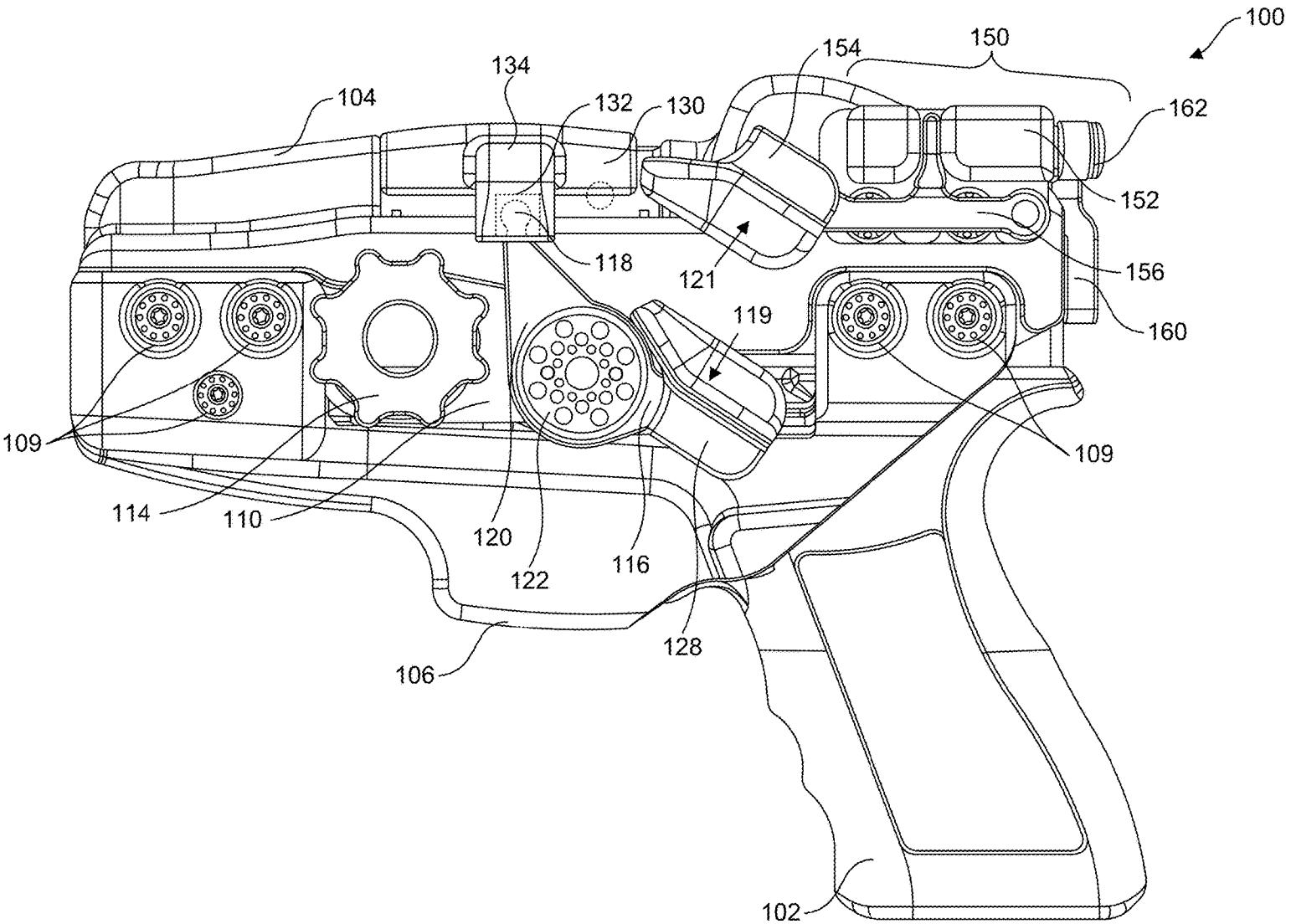
FIG. 1 illustrates a left side view of one embodiment of a firearm holster in accordance with the invention.
Figure 2:
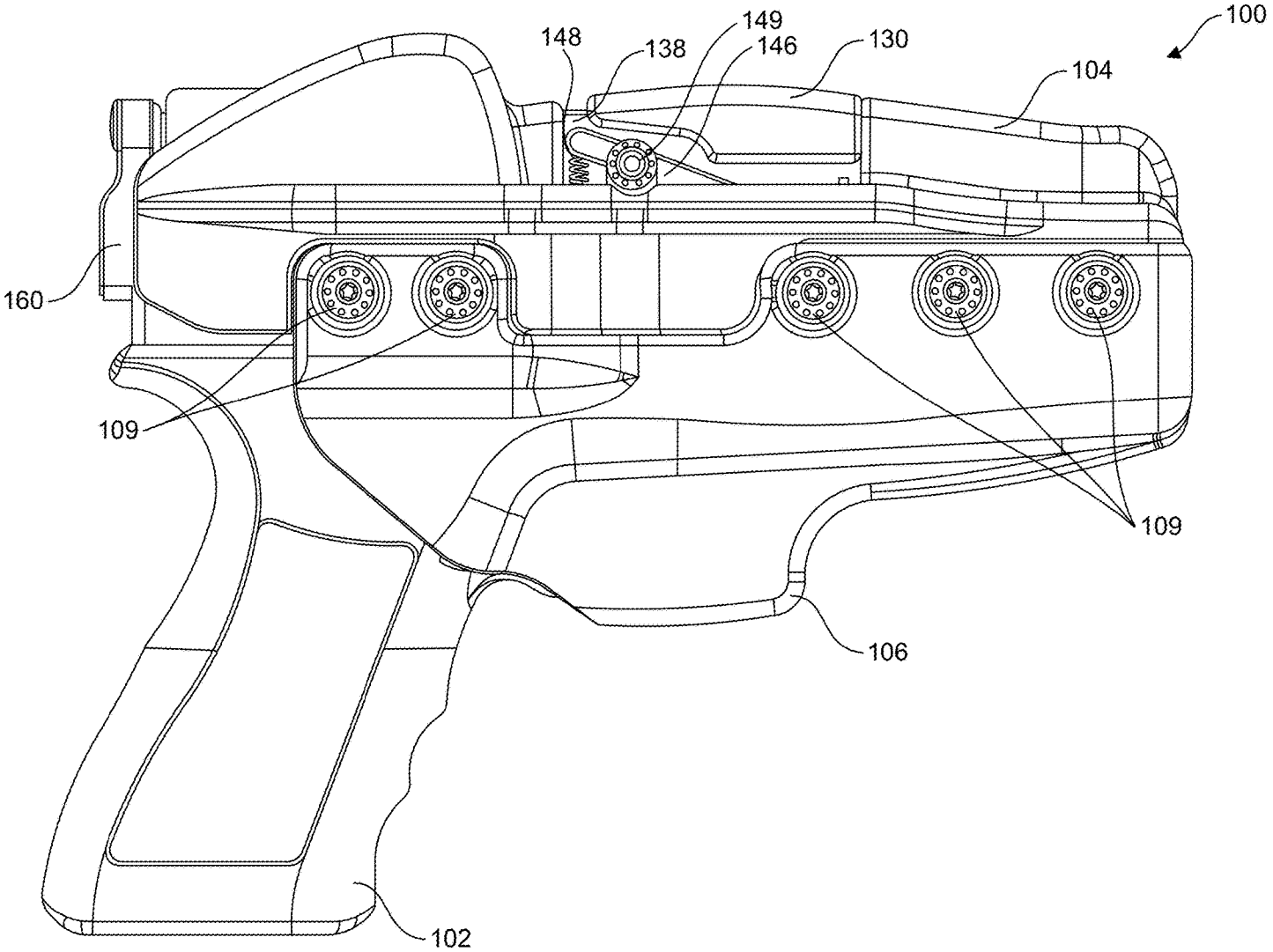
FIG. 2 illustrates a right side view of one embodiment of a firearm holster in accordance with the invention.
Figure 3:
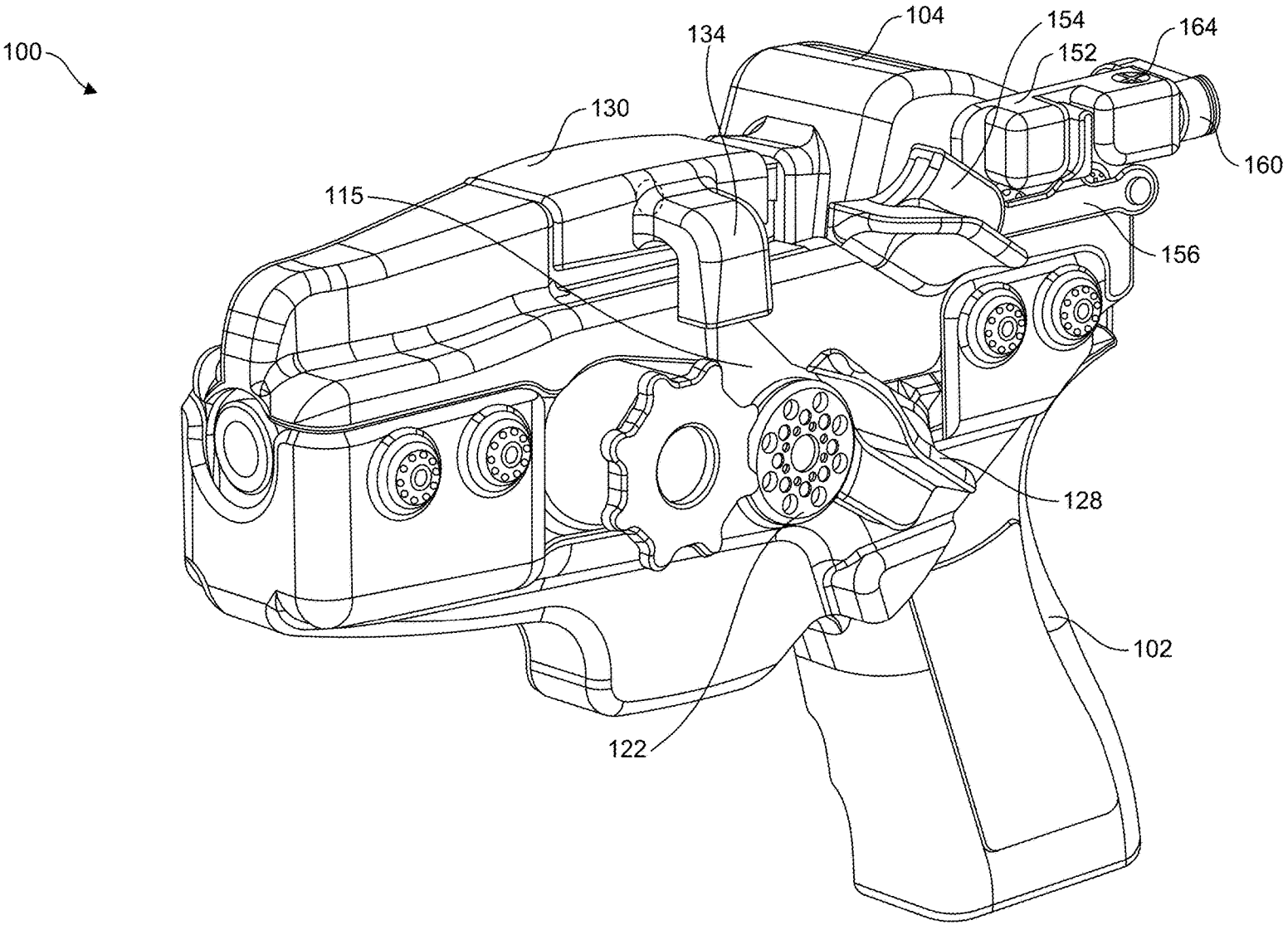
FIG. 3 illustrates a left front perspective view of one embodiment of a firearm holster in accordance with the invention.
Figure 4:
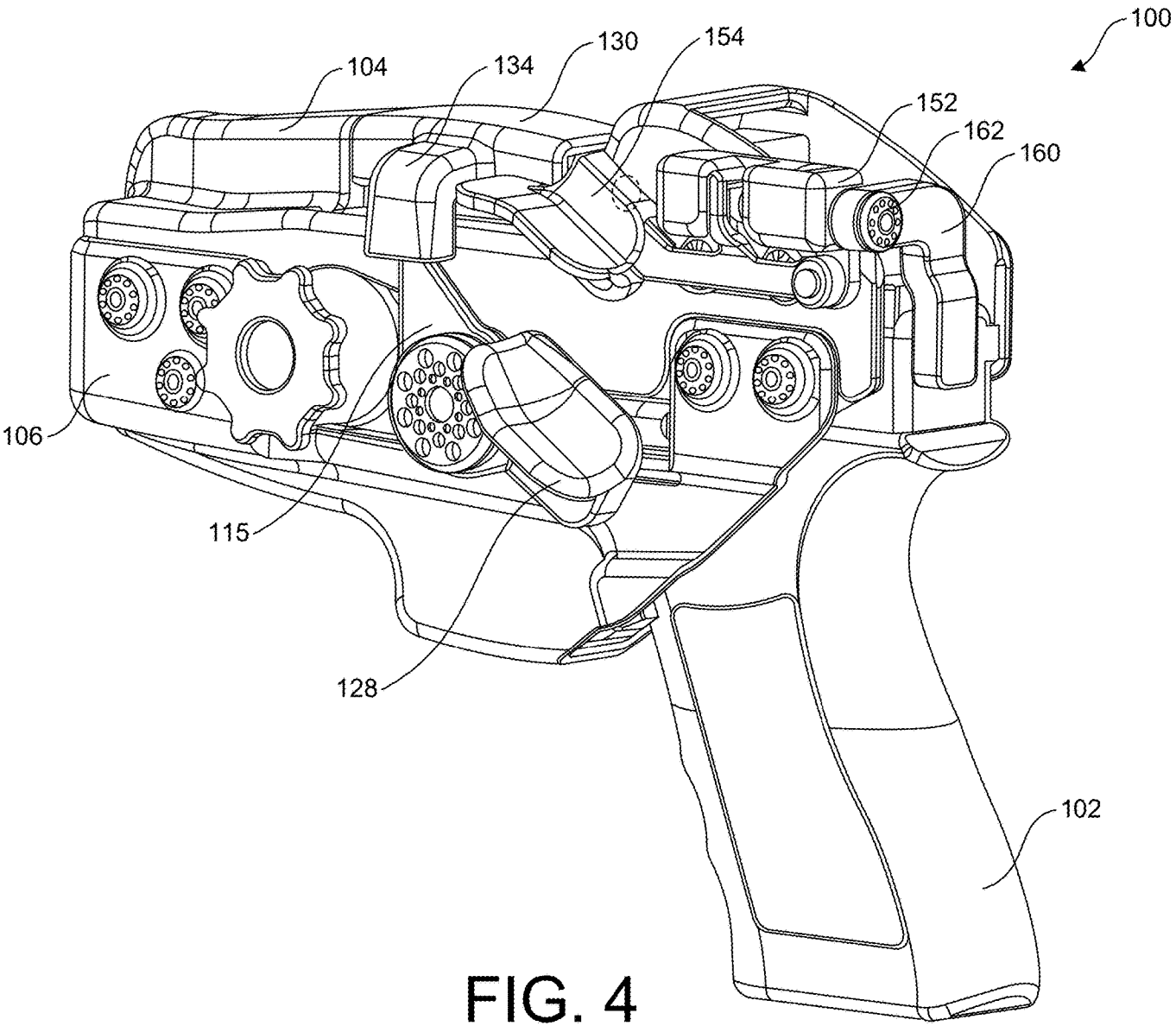
FIG. 4 illustrates a left back perspective view of one embodiment of a firearm holster with a secondary lock in the locked position in accordance with the invention.
Figure 5:
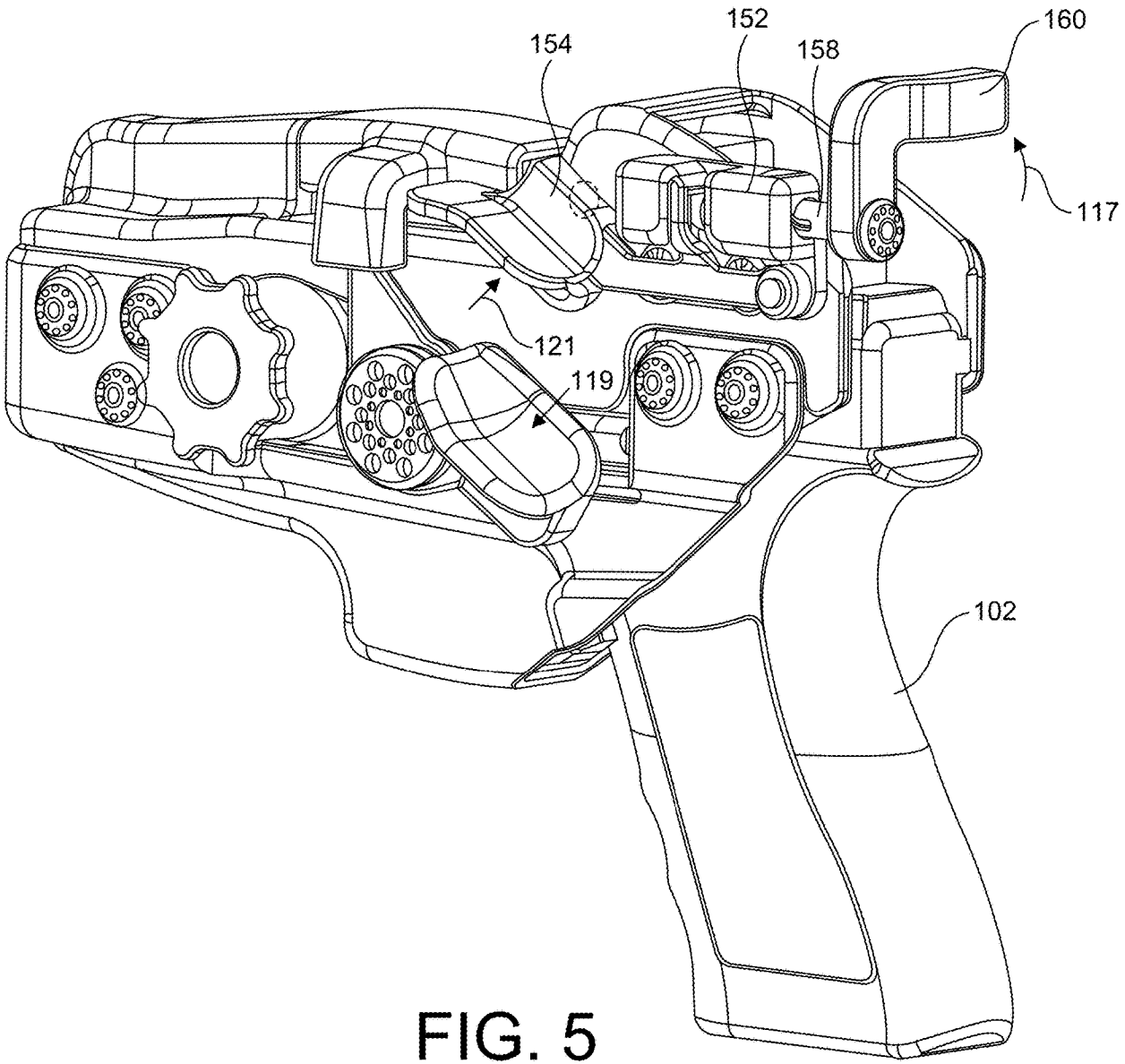
FIG. 5 illustrates a left back perspective view of one embodiment of a firearm holster with a secondary lock in the unlocked position in accordance with the invention.
Figure 6:
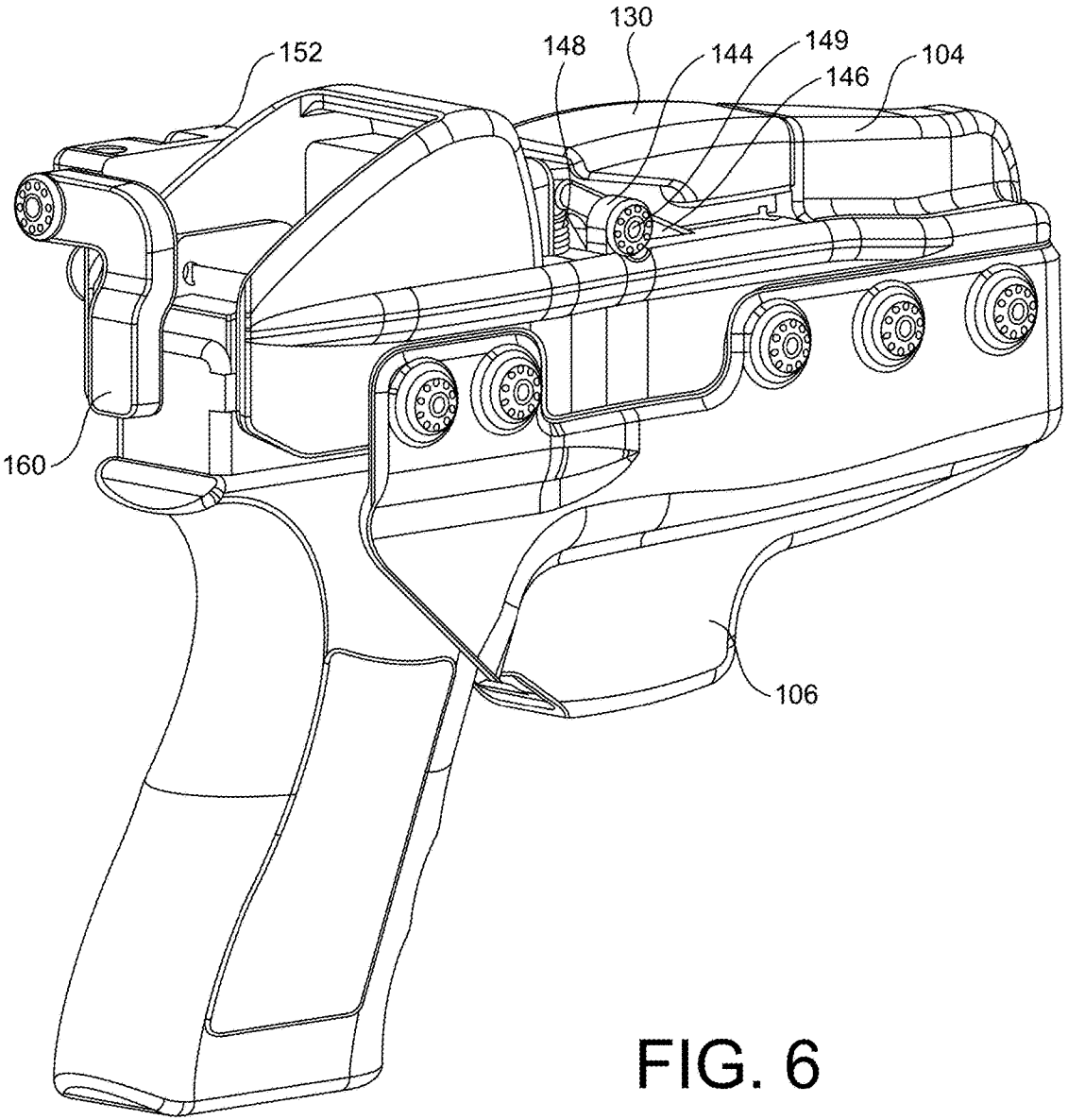
FIG. 6 illustrates a right back perspective view of one embodiment of a firearm holster with a secondary lock in the locked position in accordance with the invention.
Figure 7:
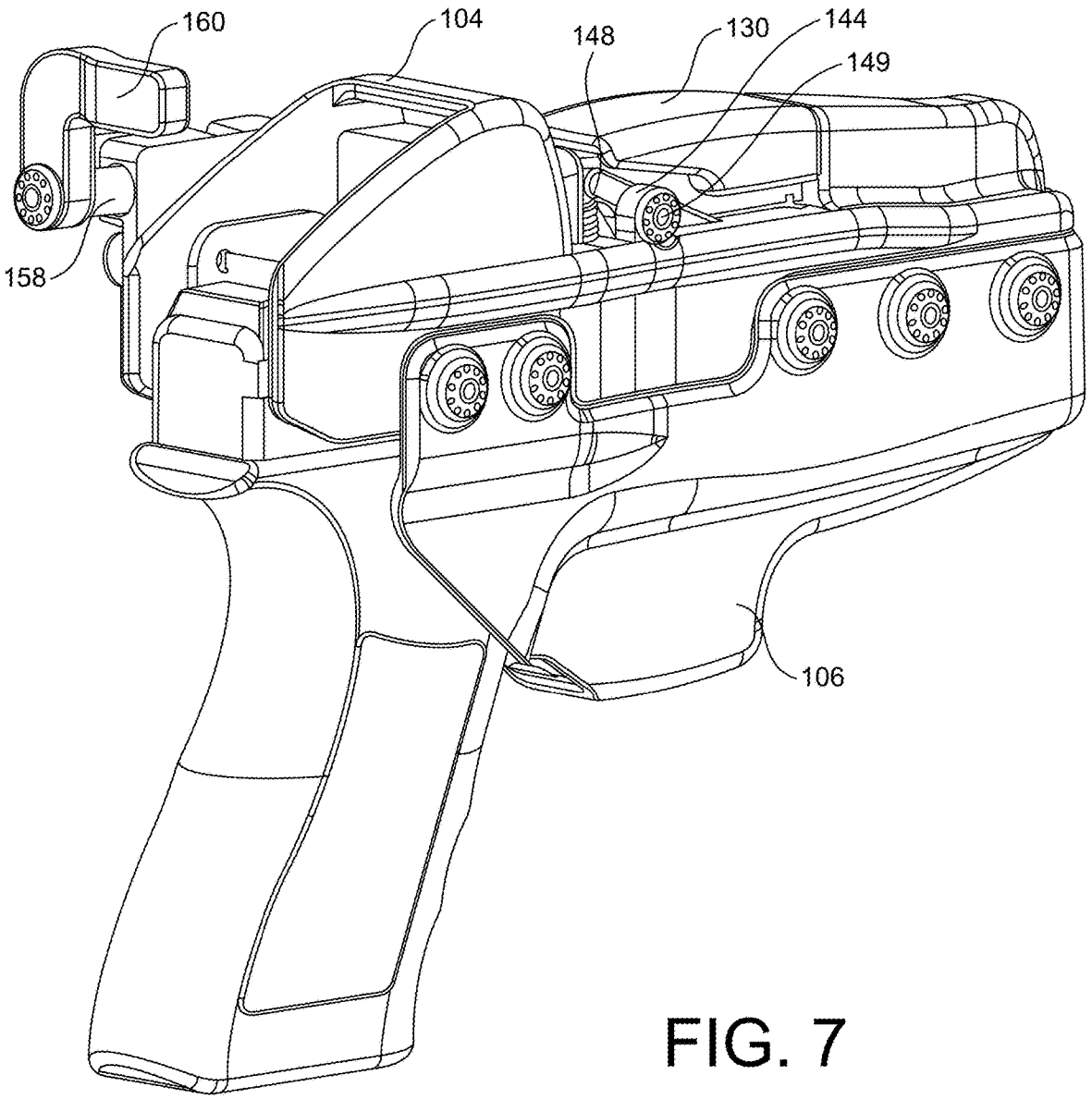
FIG. 7 illustrates a right back perspective view of one embodiment of a firearm holster with a secondary lock in the unlocked position in accordance with the invention.
Figure 8:
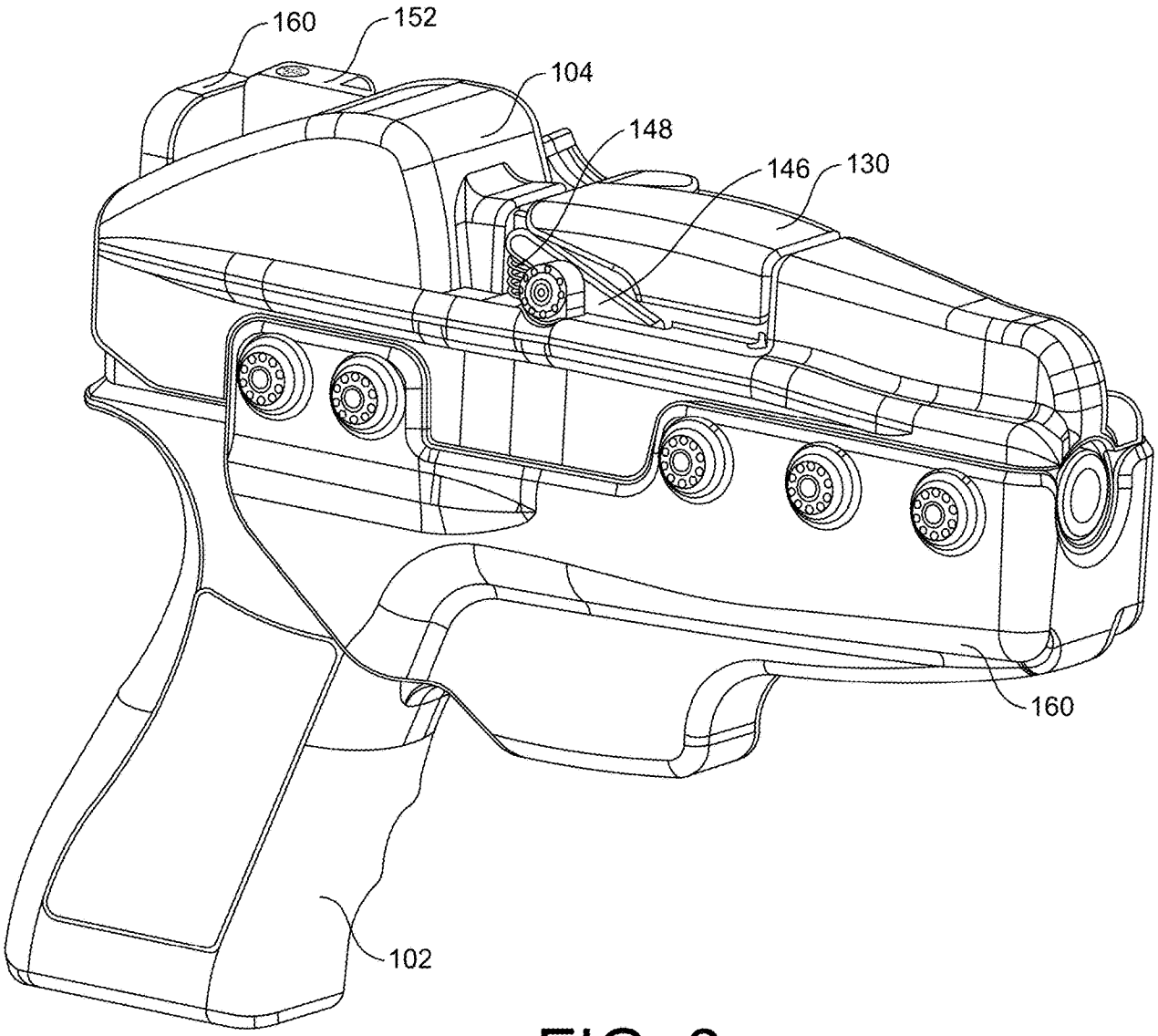
FIG. 8 illustrates a right front perspective view of one embodiment of a firearm holster with a secondary lock and a drop lock in the locked position in accordance with the invention.

The images in the drawings are simplified for illustrative purposes and are not depicted to scale. Within the descriptions of the figures, similar elements are provided similar names and reference numerals as those of the previous figure(s). The specific numerals assigned to the elements are provided solely to aid in the description and are not meant to imply any limitations (structural or functional) on the invention.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION

The embodiments of the disclosure will be best understood by reference to the drawings, wherein like parts are designated by like numerals throughout. It will be readily understood that the components, as generally described and illustrated in the Figures herein, could be arranged and designed in a wide variety of different configurations or be entirely separate. Thus, the following detailed description of the embodiments of the system and method of the disclosure, as represented in the Figures, is not intended to limit the scope of the disclosure, as claimed, but is merely representative of possible embodiments of the disclosure.

Figure 10:
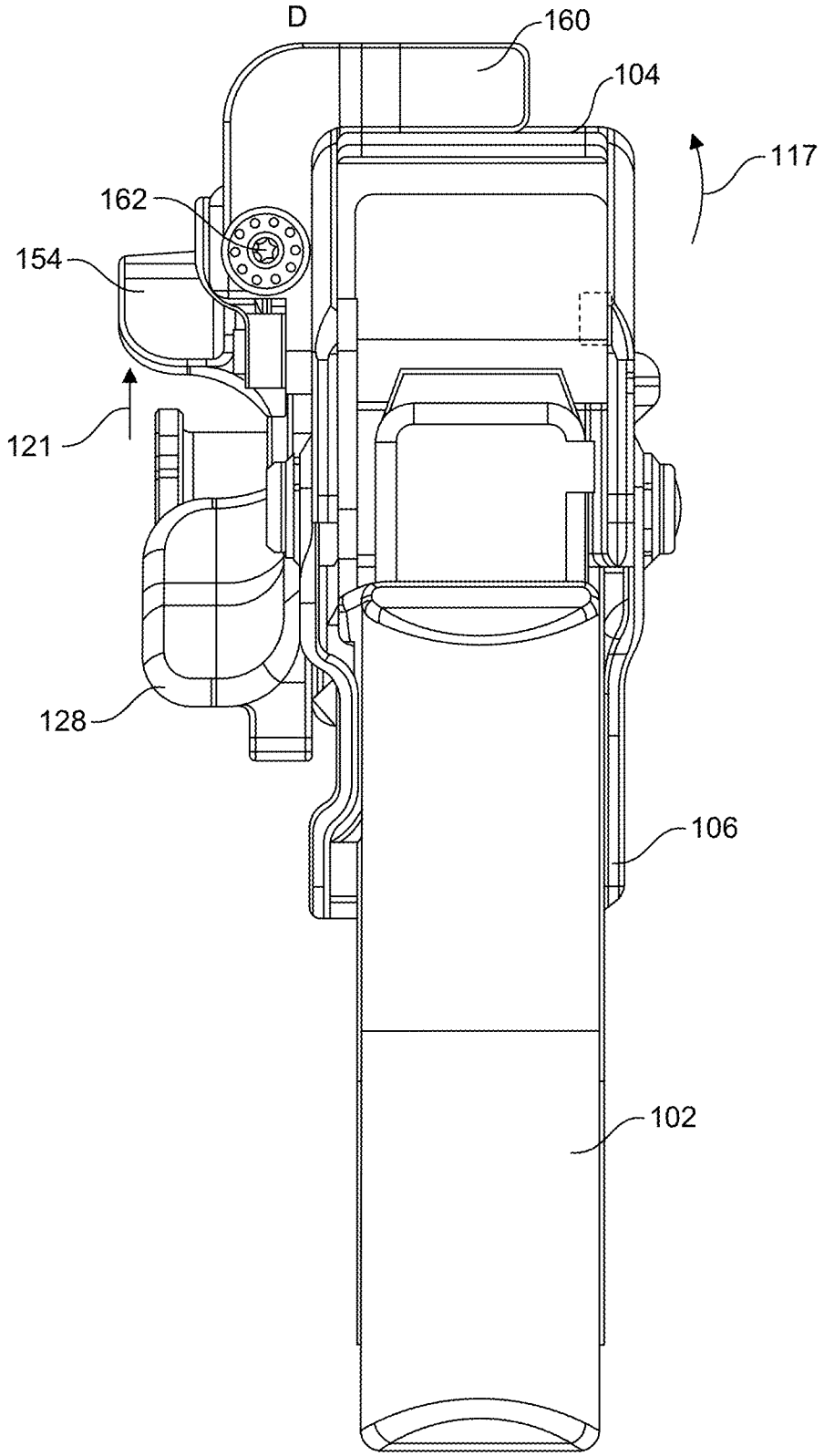
FIG. 10 illustrates a back view of one embodiment of a firearm holster with a secondary lock in the unlocked position in accordance with the invention.
Figure 11:
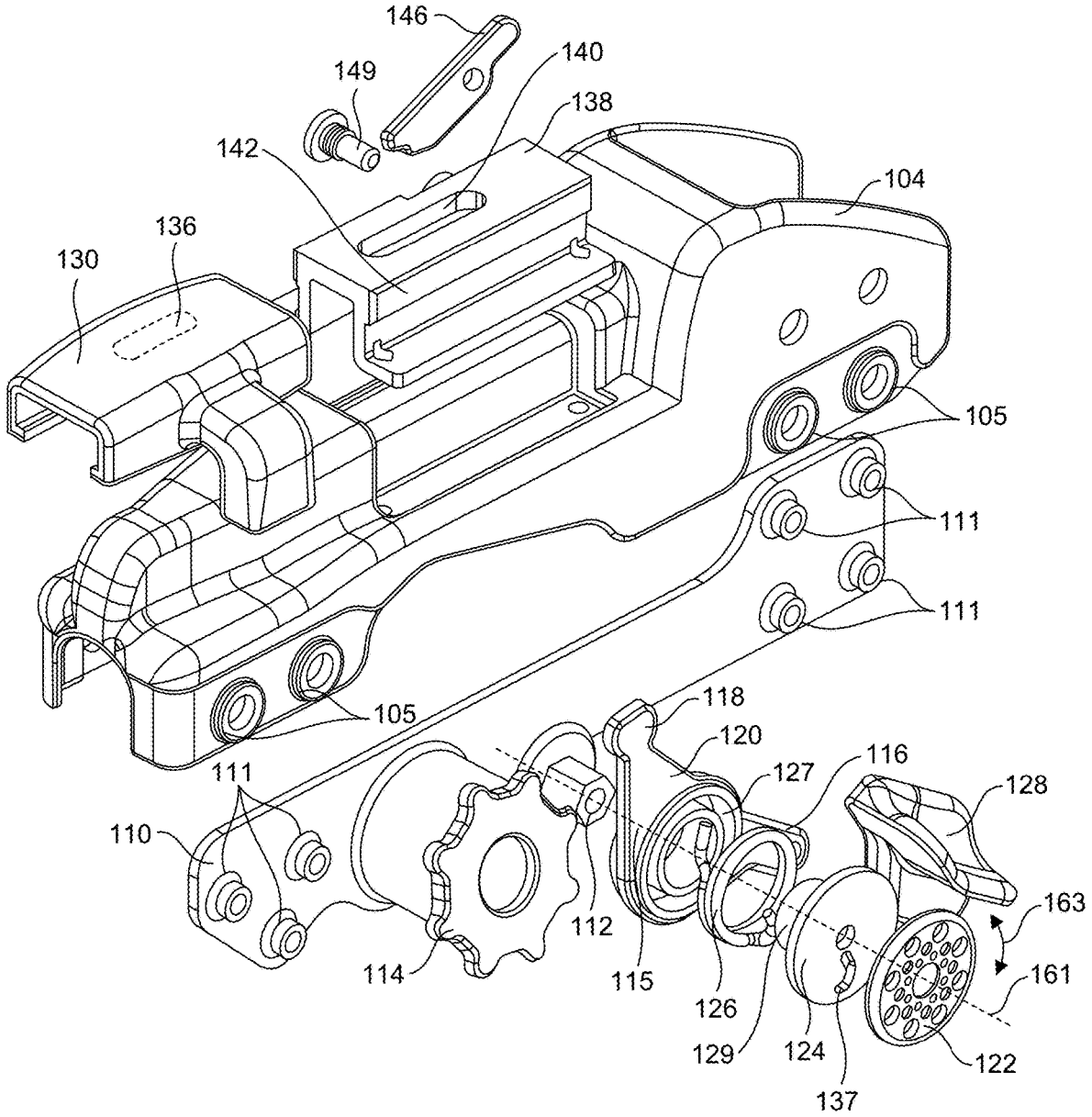
FIG. 11 illustrates an exploded view of one embodiment of a firearm holster in accordance with the invention.
Figure 12:
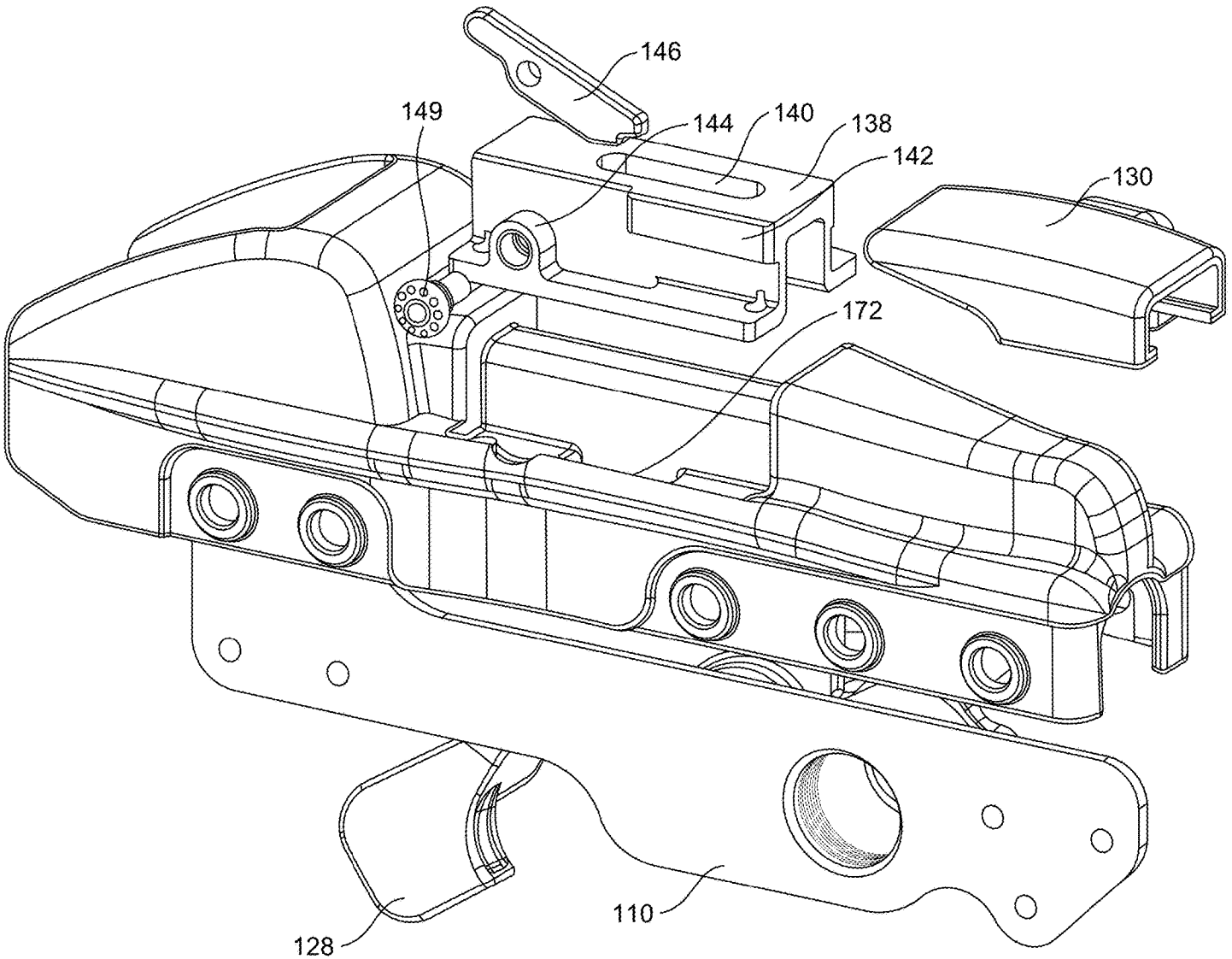
FIG. 12 illustrates an exploded view of one embodiment of a firearm holster in accordance with the invention.
Figure 13:
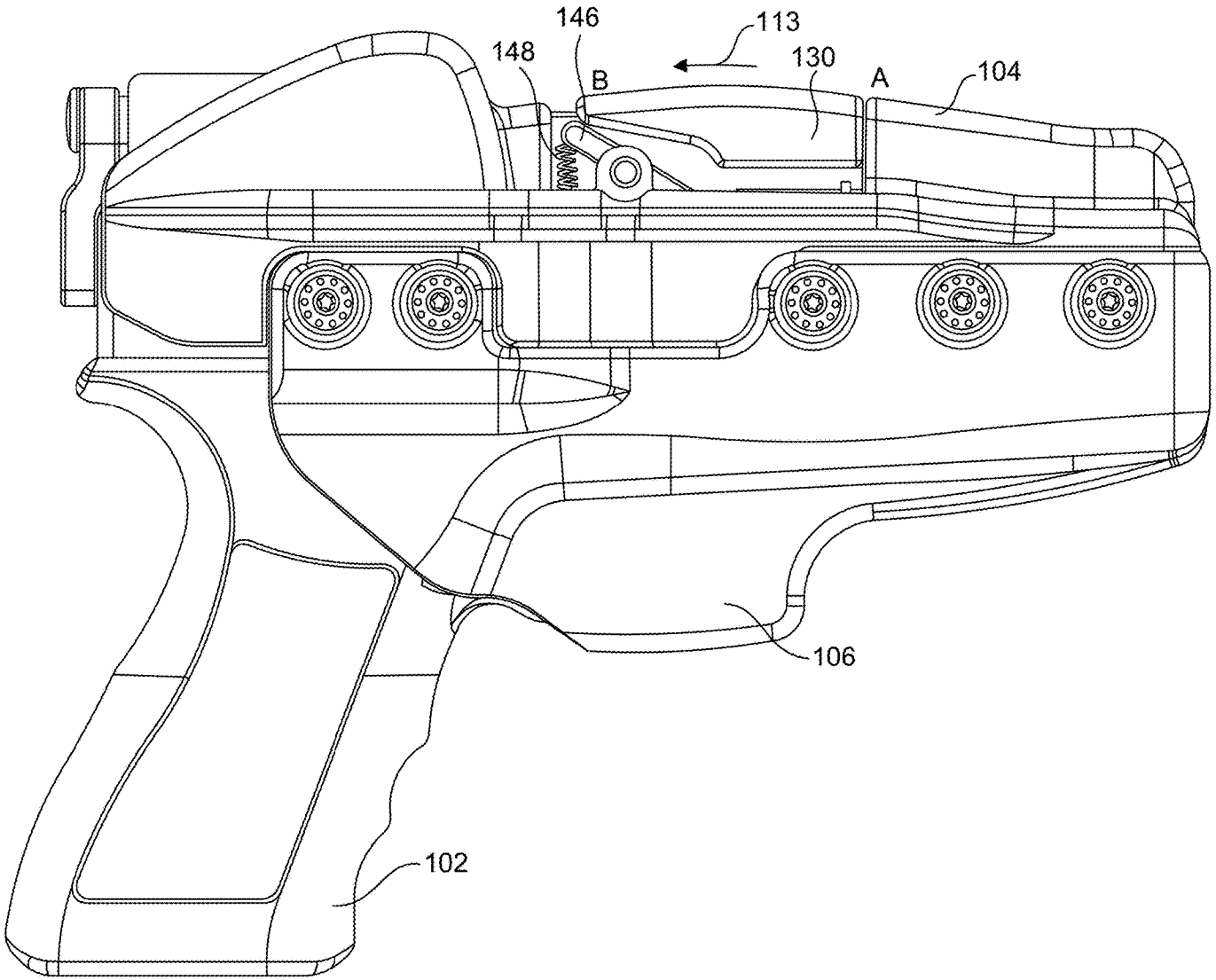
FIG. 13 illustrates a right side view of one embodiment of a firearm holster with a drop lock in the locked position in accordance with the invention.

FIGS. 1-34 illustrate embodiments of a firearm holster 100 in accordance with the invention. FIG. 1 shows a firearm holster 100 enclosing a firearm 102. The firearm holster 100 includes a top frame 104 and a lower body 106. The firearm holster 100 is configured to receive and securely engage the firearm 102. In some embodiments, the firearm holster 100 will be form fitted to snugly secure the firearm 102, providing one level of retention. A backbone 110 is operable to couple the top frame 104 of the firearm holster 100 to the lower body 106 of the firearm holster 100. As illustrated in FIG. 11, frame couplers 111 are operable to couple to a top frame 104 and lower body 106 of a firearm holster 100. The frame couplers 111 are operable to align with holes 105 in the top frame 104 and holes 107 in the lower body 106 and receive and secure screws 109 to assemble the firearm holster 100. Screws or other means for fastening the lower body 106 to the top frame 104 are rated to withstand 1,000 pounds of force. Other means for attaching the lower body 106 to the top frame 104 include adhesive, bolts, and rivets, for example. In some embodiments, a triggering lever mount 112 is defined by the backbone 110 and is operable to receive and secure a pivotal triggering lever 116. In some embodiments, the triggering lever mount 112 is hexagonal, as illustrated in FIG. 11. In one embodiment, the backbone 110 includes mount 114 attached to the backbone body operable to secure to a belt clip or a harness, for example.

Figure 14:
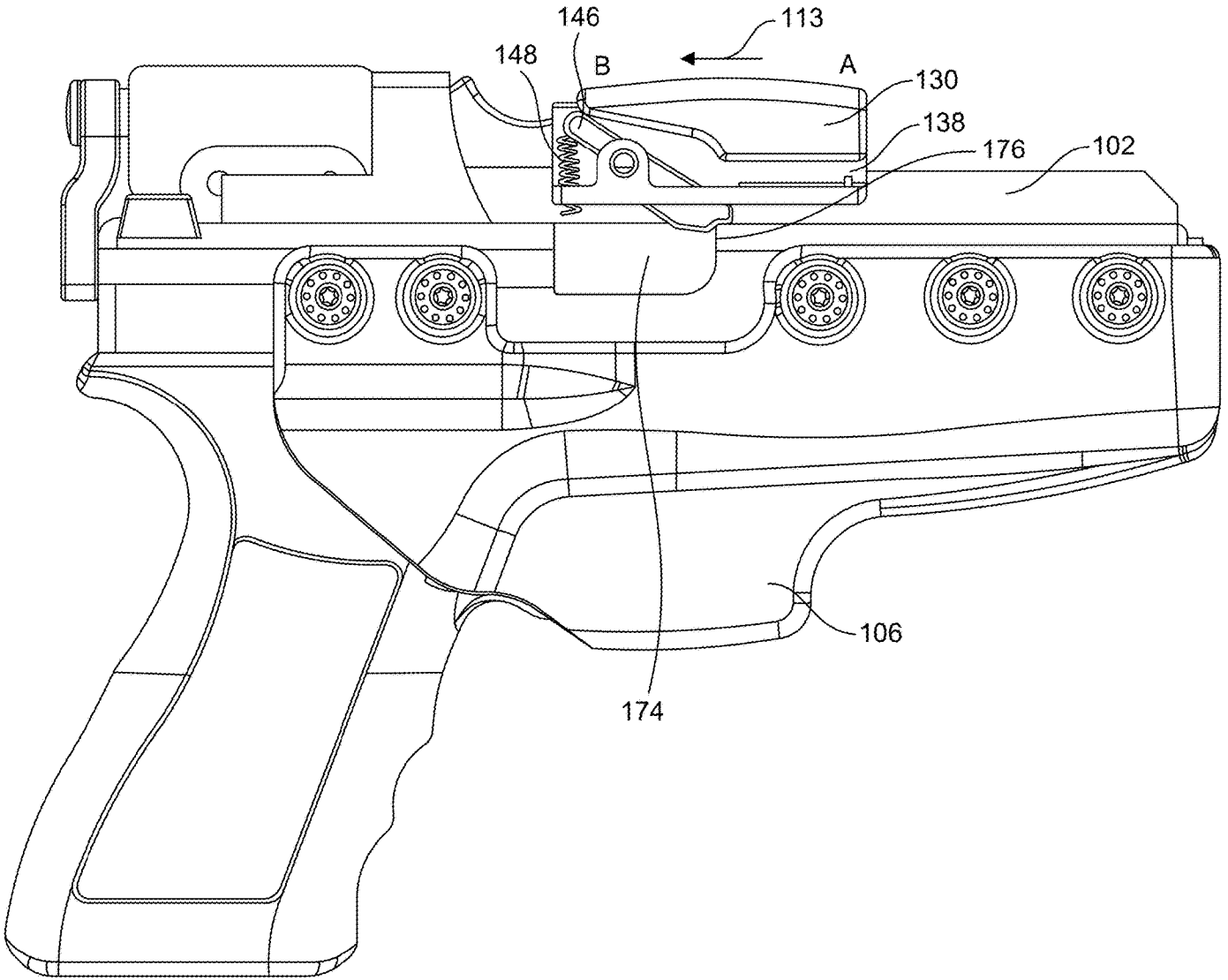
FIG. 14 illustrates a right side view of one embodiment of a firearm holster with a top frame removed and with a drop lock in the locked position engaging an ejection port wall in accordance with the invention.
Figure 15:
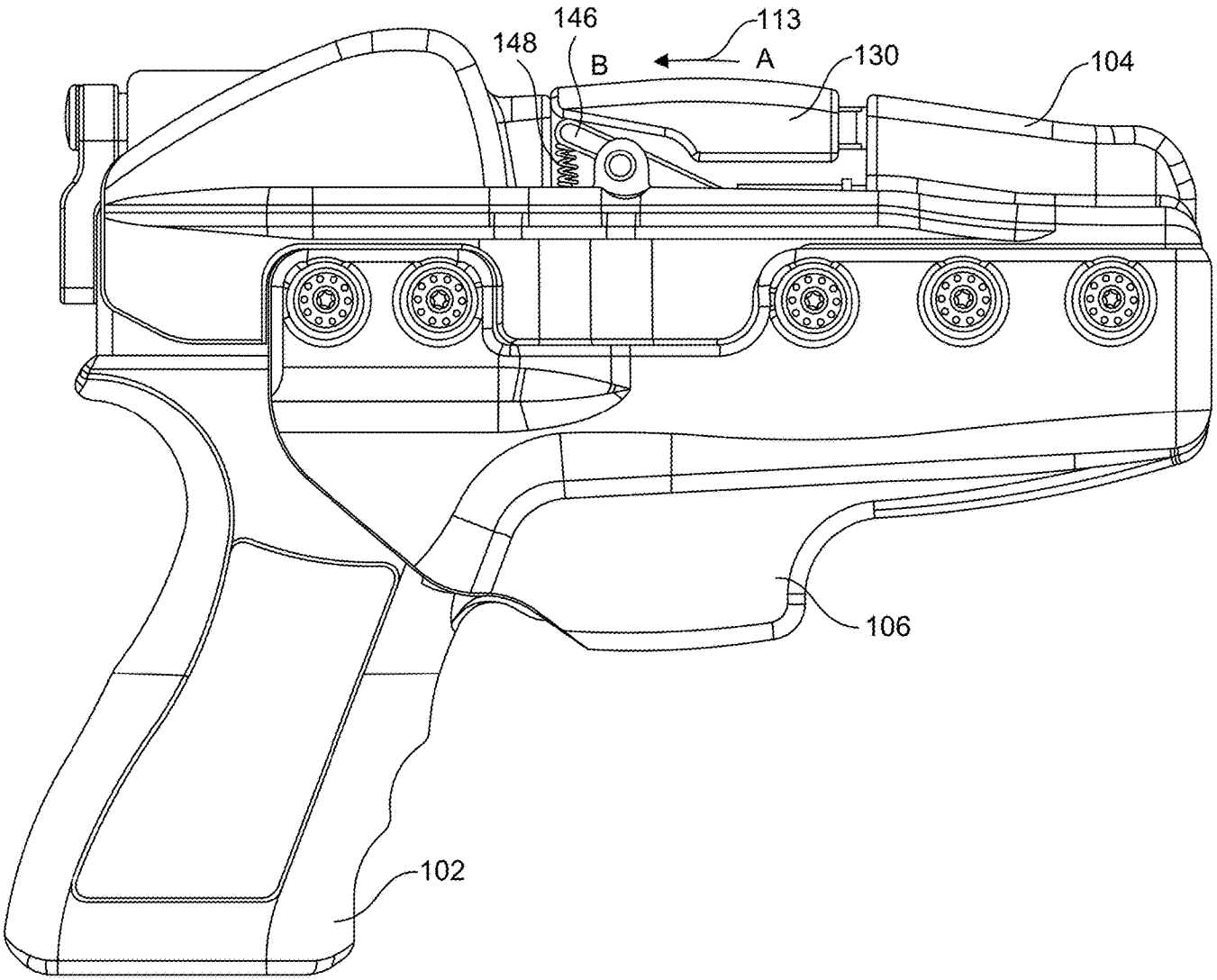
FIG. 15 illustrates a right side view of one embodiment of a firearm holster with a drop lock in the unlocked position in accordance with the invention.
Figure 16:
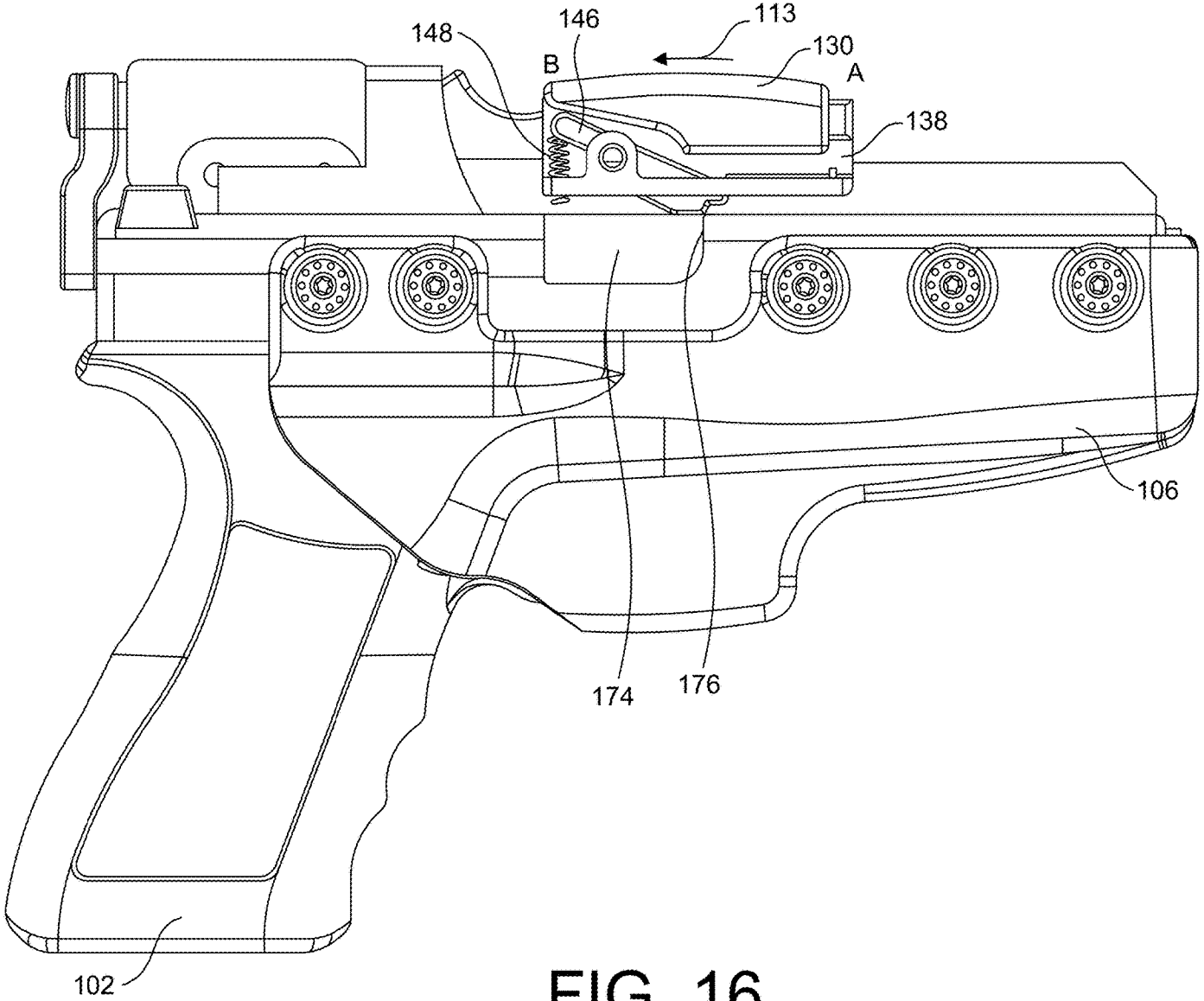
FIG. 16 illustrates a right side view of one embodiment of a firearm holster with a top frame removed and with a drop lock in the unlocked position disengaged with an ejection port wall in accordance with the invention.
Figure 17:
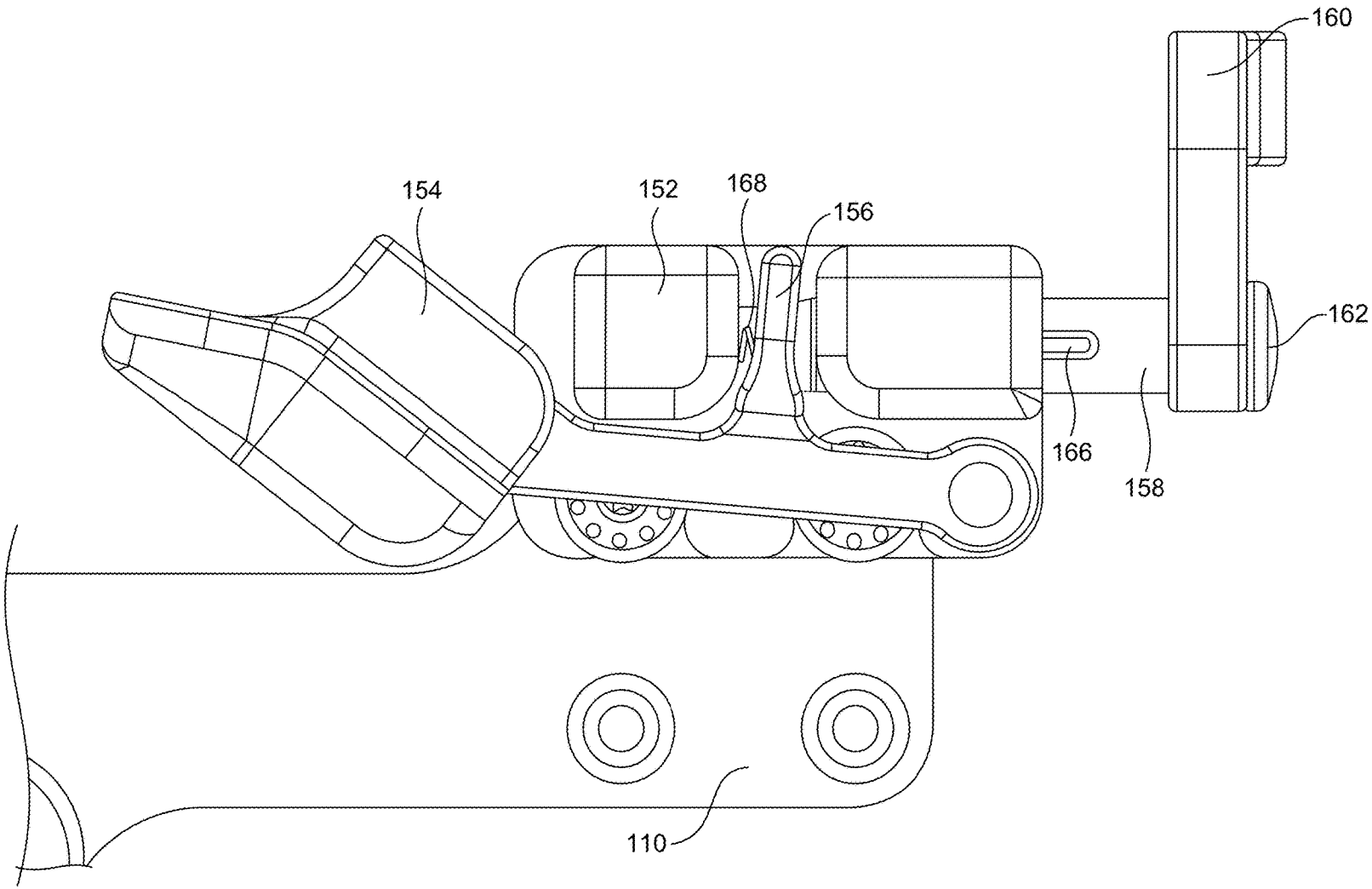
FIG. 17 illustrates a left side view of one embodiment of a secondary lock assembly of a firearm holster in accordance with the invention.

A slider 130 is slidably attached to and operable to slide along a slider base 138 atop the frame 104. As illustrated in FIGS. 13-16, the slider 130 is operable to slide between the locked position A to the unlocked position B in the direction of arrow 113. A resettable drop lock 146 is pivotably attached to the slider base 138 via a resettable drop lock mount 144 defined by the slider base 138. The resettable drop lock 146 is configured to pivot on resettable drop lock screw 149 between a locked position and an unlocked position, as illustrated in FIGS. 13-16. A drop lock spring 148 is disposed between the resettable drop lock 146 and the slider base 138 and operable to bias the resettable drop 146 into the locked position A. In the locked position, the resettable drop lock 146 extends through a resettable drop lock passage 172 (shown in FIGS. 13 and 14) and sits within the ejection port 174 of the firearm 102. (The ejection port 174 of the firearm 102 is illustrated in FIGS. 14 and 16. The resettable drop lock 146 is spring biased by drop lock spring 148 and, when in the down and locked position, the firearm 102 cannot be removed from the holster 100, as the spring bias forces the resettable drop lock 146 into the ejection port 174, providing a second level of retention. In operation, when the resettable drop lock 146 is in the locked position A, the end of the resettable drop lock 146 will protrude into the ejection port 174. Should a user attempt to remove the firearm 102 from the holster 100 while the resettable drop lock 146 is in the locked position, the end of the resettable drop lock 146 will make contact with an ejection port wall 176, preventing the firearm 102 from moving towards the back of the holster 100. When in the unlocked position, slider 130 will be slid towards the back of the holster 100 and the resettable drop lock 146 will pivot out of the ejection port 174. The drop lock spring 148 is operable to automatically bias the resettable drop lock 146 into the locked position, eliminating the need for the user to lock the secondary level of retention. Once a user inserts the firearm 102 into the holster 100, the resettable drop lock 146 will automatically pivot into and lock within the ejection port 174.

Figure 25:
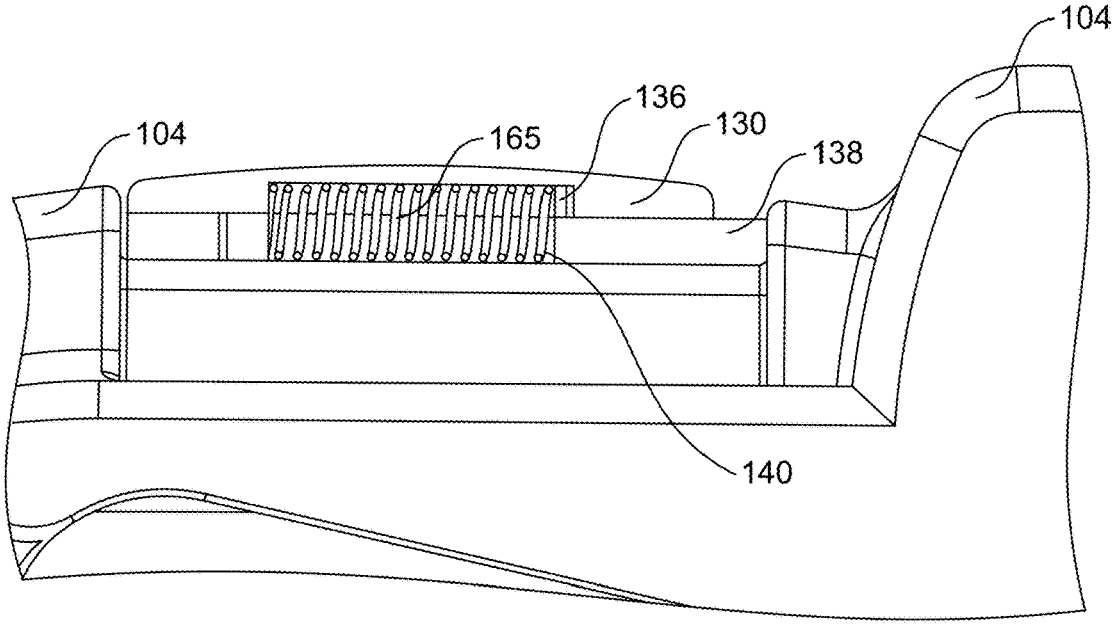
FIG. 25 illustrates a partial cut away view of one embodiment of a slider in a locked position in accordance with the invention.
Figure 26:
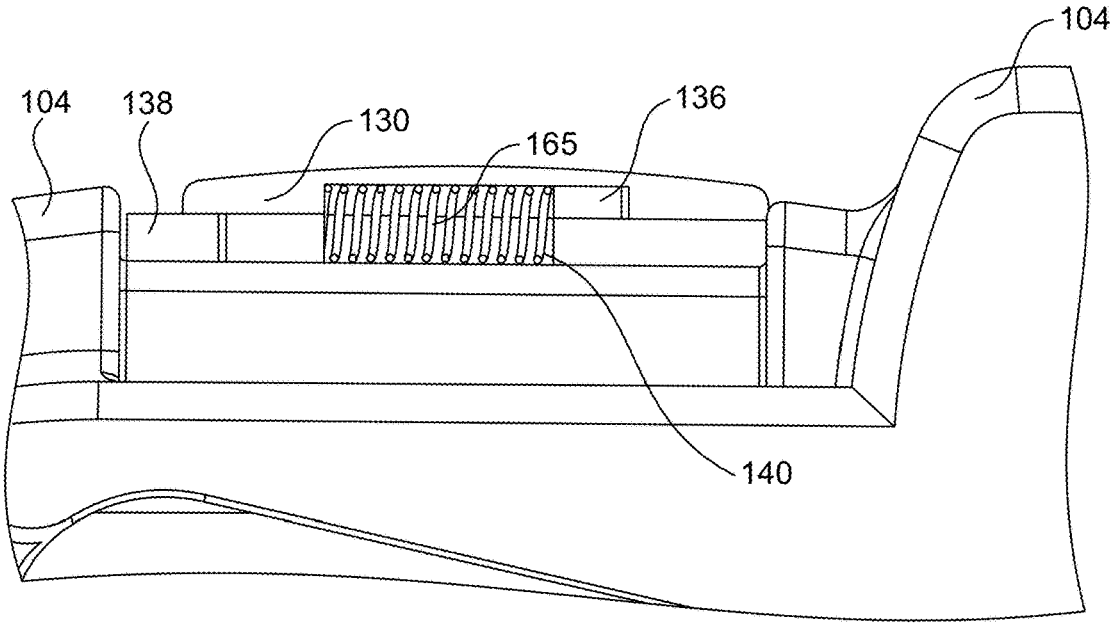
FIG. 26 illustrates a partial cut away view of one embodiment of a slider in an unlocked position in accordance with the invention.

As illustrated in FIGS. 25-26, the slider 130 defines a slider spring cavity 136 operable to receive and secure a slider spring 165. The slider base 138 defines a slider base spring cavity 140 operable to receive and enclose the slider spring 165. As illustrated in FIG. 25, the spring 165 biases the slider 130 towards the front of the holster 100 into a locked position. Upon receipt of a force by a user to move the slider 130 from the locked position into an open position, as illustrated in FIG. 26, the spring 165 will compress and thereby bias the slider 130 into the locked position.

Figure 22:
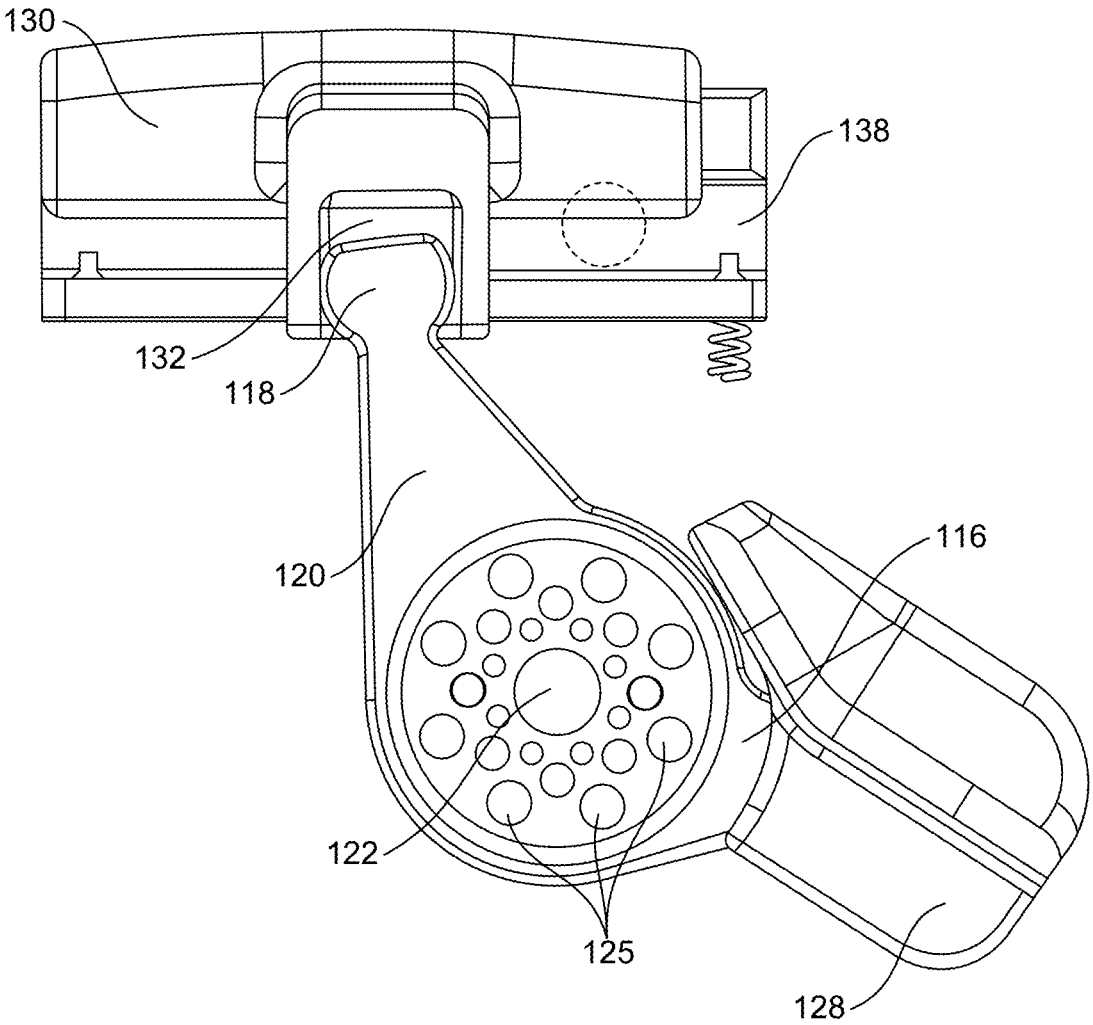
FIG. 22 illustrates partial cutaway view of one embodiment of a drive arm of a triggering lever engaging a slider socket in accordance with the invention.

In one embodiment, to provide a second level of retention, a pivotal triggering lever 115 is attached to the firearm holster 100 via a triggering lever mount 112, as illustrated in FIG. 11. In the embodiment illustrated in the Figures, the triggering lever mount 112 is a male hexagonal mount. The pivotal triggering lever 115 has a triggering arm 116 opposite a drive arm 120. As illustrated in FIG. 22, a drive head 118 of the drive arm 120 engages an extension arm 134 of the slider 130 via socket 132. A thumb pad 128 is attached to the triggering arm 116. In one embodiment, triggering lever mount 112 is integrated directly or overmolded into the top frame 104. For example, the triggering lever mount 112 may be manufactured from a metal such as aluminum and the top frame 104 may be manufactured from plastic by injection mold. The triggering lever mount 112 may be placed in the mold for the frame 104 and overmolded into the top frame 104. In some embodiments, the triggering lever mount 112 and the top frame 104 may be manufactured together and from the same materials, such as plastic or metal.

Figure 21:
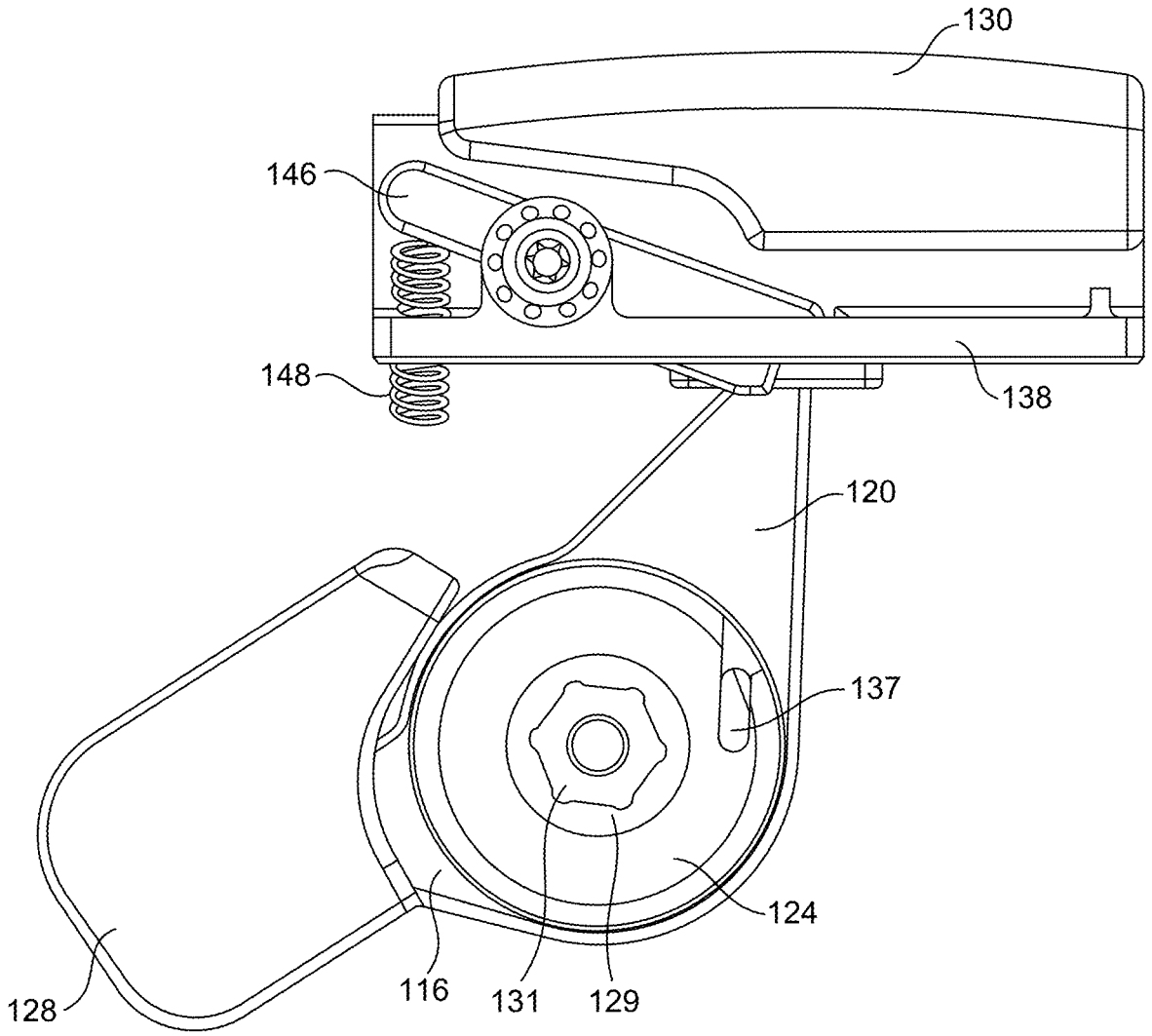
FIG. 21 illustrates a right side view of one embodiment of a triggering lever and a slider of a firearm holster in accordance with the invention.

FIG. 11 illustrates an exploded view of the holster 100 in accordance with embodiments of the present invention. A triggering lever spring tension device 124 is configured to engage with and couple to the triggering lever mount 112. A triggering lever spring 126 is configured to sit within a spring channel 127 of the triggering lever 115. FIG. 21 illustrates the triggering lever spring tension device 124 having a cylindrical shaft portion 129 defining an internal female hexagonal connector 131 operable to couple to the triggering lever mount 112. The triggering lever spring tension device 124 further defines a spring end opening 137. A triggering lever assembly screw 122 secures the triggering lever to the triggering lever mount 112.

As illustrated in the Figures, one embodiment of the triggering assembly screw 122 defines a plurality of holes 125 for use with a spanner wrench to tighten or loosen triggering assembly screw 122.

A novel aspect of the invention enables the user to adjust the force required to rotate the triggering lever 115 to remove the firearm 102 from the holster 100. This is advantageous for applications that may require stronger levels of retention by the holster 100, such as crowd control or riots. Using the spring tension of the triggering lever spring 126, the user may selectively attach the triggering lever spring tension device 124 to the triggering lever mount 112 along the hexagonal coupler to increase or decrease the tension in the triggering lever spring 126. Referring to FIG. 11, triggering lever spring tension device 124 has a central axis 161. When uncoupled from the triggering lever mount 112, the user can rotate the triggering lever spring tension device 124 on the axis 161 in either direction as indicated by arrow 163. By rotating the triggering lever spring tension device 124 by 60 degrees in one direction, tension in the triggering lever spring 126 will increase, and by rotating the triggering lever spring tension device 124 by 60 degrees in the opposite direction, tension in the triggering lever spring 126 will decrease. By using increments of 60 degrees, the hexagonal coupler 112 and the female hexagonal connector 131 will align to mate and can be fastened together. A user may choose to rotate the triggering lever spring tension device 124 by multiple increments of 60 degrees to increase or decrease the tension in the triggering lever spring 126 for as far as the spring will coil or uncoil. As illustrated in the Figures, the trigger lever mount 112 and the female hexagonal connector 131 are male and female and hexagonal in shape. However, in other embodiments, the trigger lever mount 112 and the female hexagonal connector 131 may be other geometric shapes, such as a square or octagon, for example. In embodiments utilizing other shaped connectors, the increments to rotate the triggering lever spring tension device 124 will vary.

Figure 23:
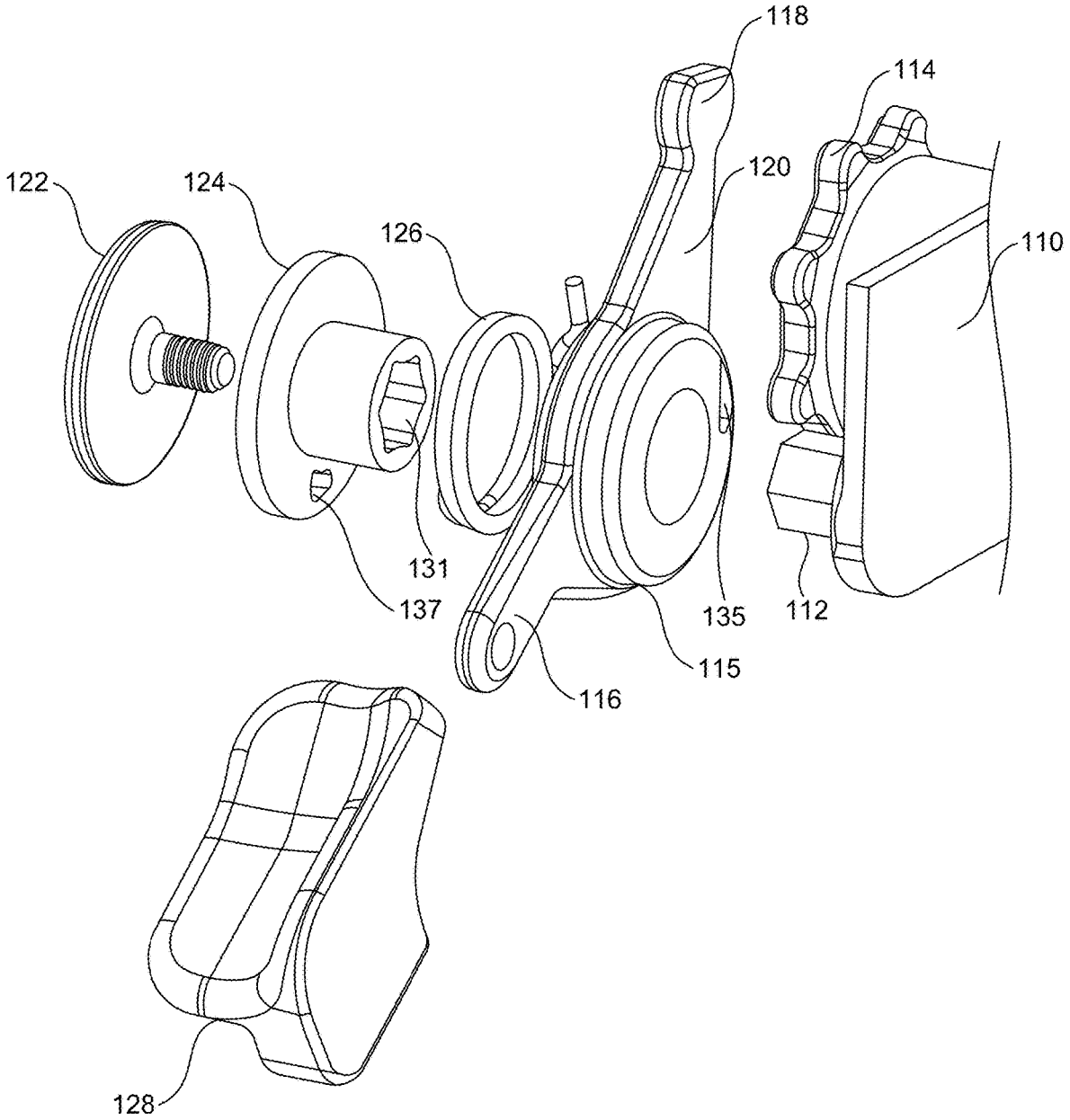
FIG. 23 illustrates an exploded view of one embodiment of a pivotal triggering lever assembly in accordance with the invention.
Figure 24:
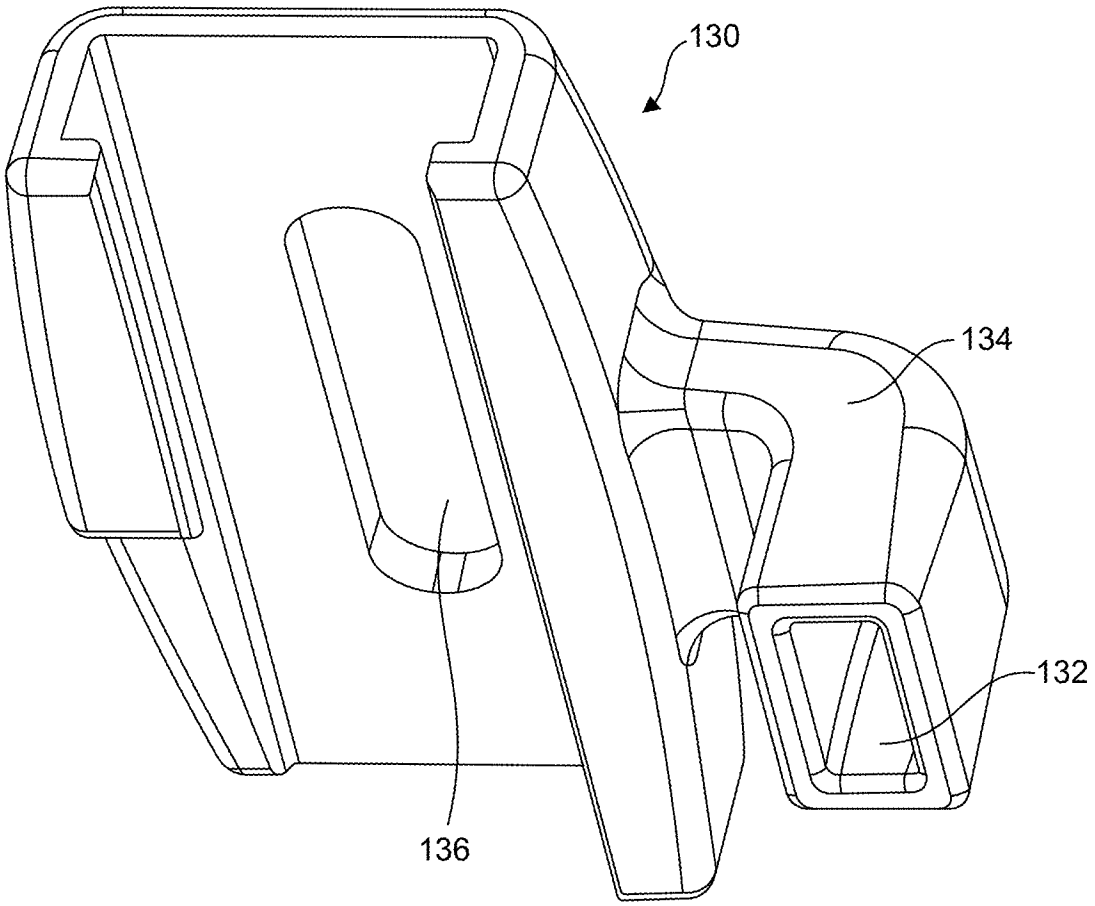
FIG. 24 illustrates a bottom front left perspective view of one embodiment of a slider in accordance with the invention.

In one embodiment, when the holster 100 is assembled (as illustrated in FIG. 1), the triggering lever spring 126 is inserted into the spring channel 127. A first end of the triggering lever spring 126 protrudes through a triggering lever spring end opening 135 in the triggering lever 115. (Triggering lever spring end opening 135 is illustrated in FIG. 23). A second end of the triggering lever spring 126 protrudes through a triggering lever spring end opening 137 in the triggering lever spring tension device 124. Triggering lever 115 is slid over the cylindrical portion 139 of the triggering lever spring tension device 124 such that the triggering lever 115 is free to rotate around the cylindrical portion 139. However, this rotation is countered by the spring force from the triggering lever spring 126 as each end of the triggering lever spring 126 engages with the spring end openings 135 and 137.

As illustrated in FIG. 11, the triggering lever spring tension device 124 rigidly connects to the triggering lever mount 112 by pressing the female hexagonal connector 131 of the triggering lever spring tension device 124 over the hexagonal triggering lever mount 112. Once the triggering lever spring tension device 124 is pressed onto the hexagonal triggering lever mount 112, the triggering lever 118 is secured between the triggering lever spring tension device 124 and the backbone 110. The triggering lever 115 can rotate around the cylindrical shaft portion 138. The rotation of the triggering lever 115 around the cylindrical shaft portion 138 is limited by the triggering lever spring 134. Triggering lever assembly screw 122 is operable to screw the assembly into the triggering lever mount 112.

Figure 18:
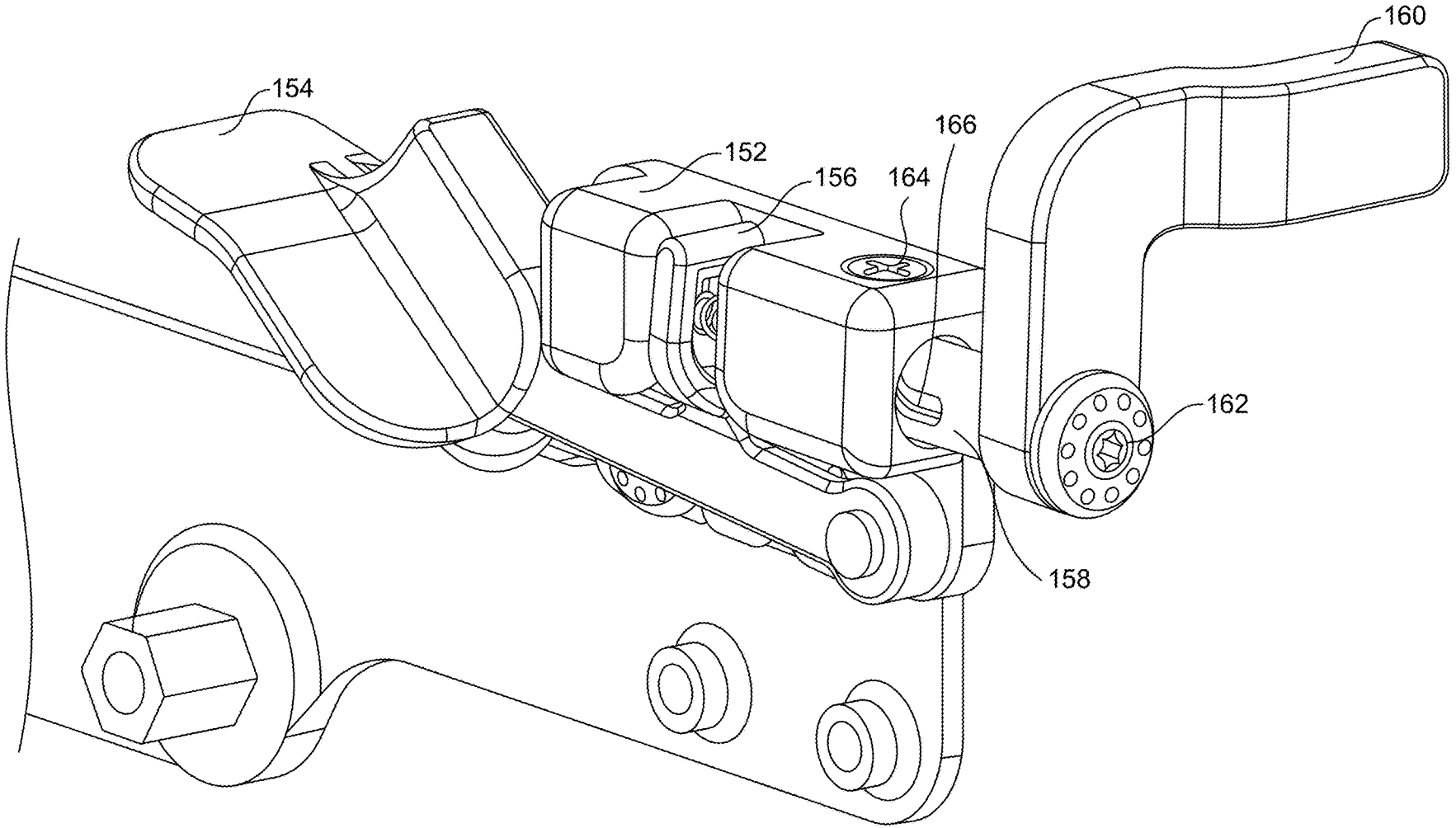
FIG. 18 illustrates a left back perspective side view of one embodiment of a secondary lock assembly of a firearm holster in accordance with the invention.
Figure 19:
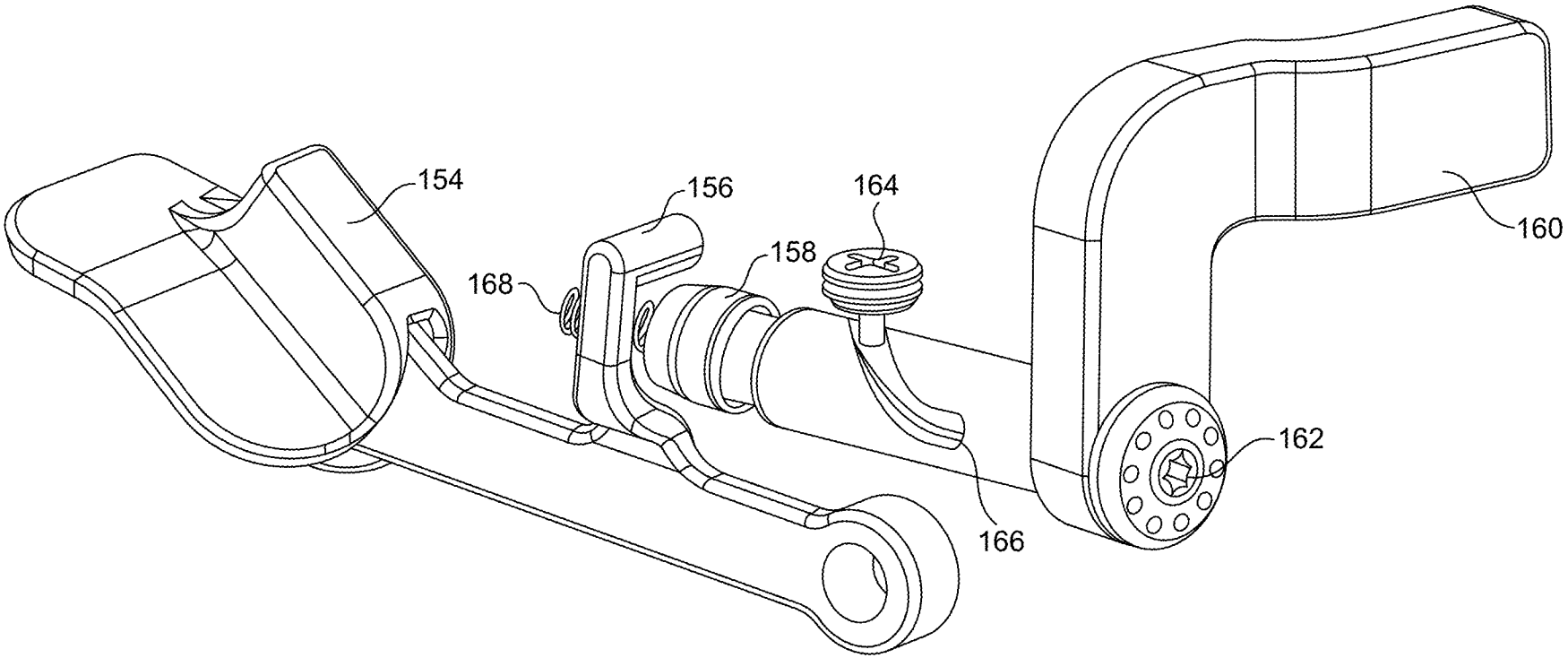
FIG. 19 illustrates a left back perspective side view of one embodiment of a secondary lock assembly of a firearm holster in accordance with the invention.
Figure 20:
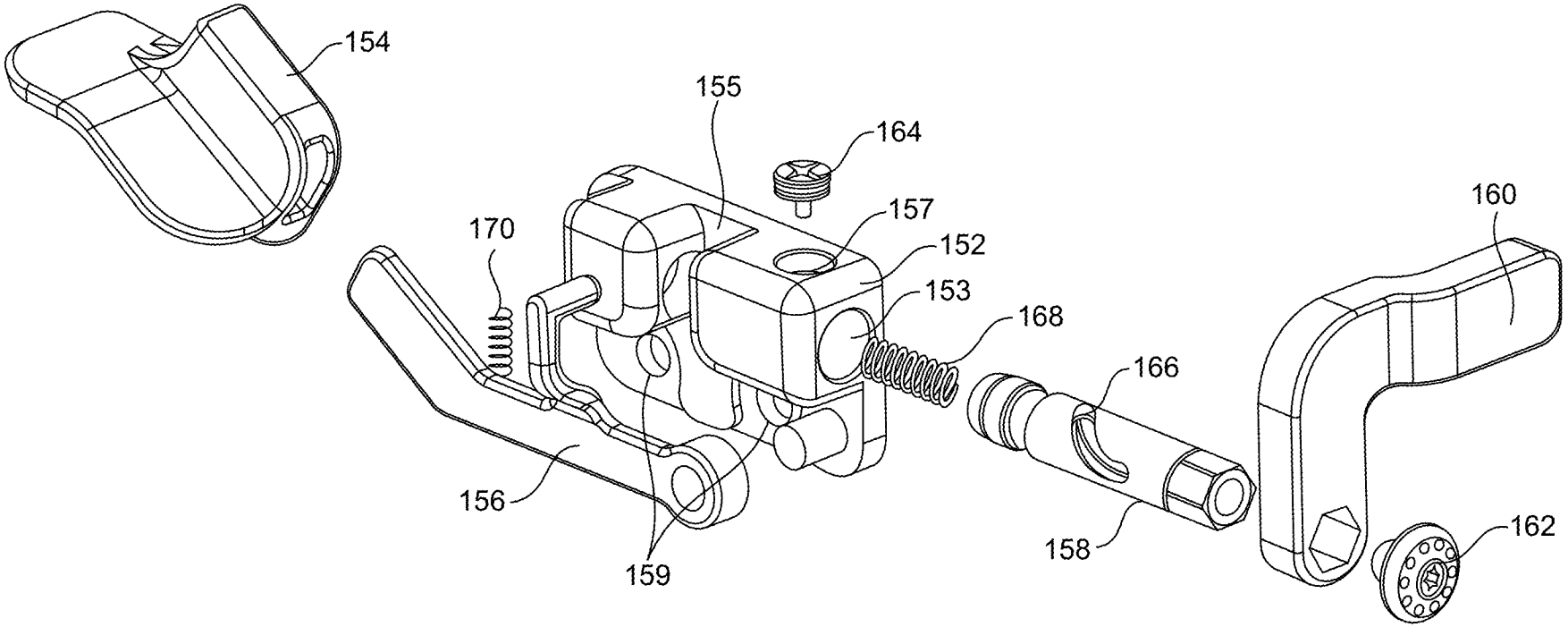
FIG. 20 illustrates a left back perspective side view of one embodiment of a secondary lock assembly of a firearm holster in accordance with the invention.

In one embodiment, as illustrated in FIGS. 18-20, to provide a third level of retention, a secondary lock assembly 150 is operable to retain a firearm 102 in a holster 100. The secondary lock assembly 150 includes a secondary lock body 152 defining a helical lock shaft passage 153. The secondary lock body 152 defines a sear lever channel 155. The secondary lock body 152 defines a helical lock guide pin aperture 157. The secondary lock body 152 is operable for attachment to a firearm holster via coupler 159. A sear lever 156 is pivotally attached to the secondary lock body 152. The sear lever 156 is operable to pivot from a locked position to an unlocked position in the direction of arrow 121. In the locked position (the locked position is show in FIG. 9), the helical lock spring is compressed between the secondary lock body 152 and the helical lock shaft 158. The sear lever 156 is operable to engage and retain the helical lock shaft 158 to prevent it from extending from the secondary lock body 152.

Figure 9:
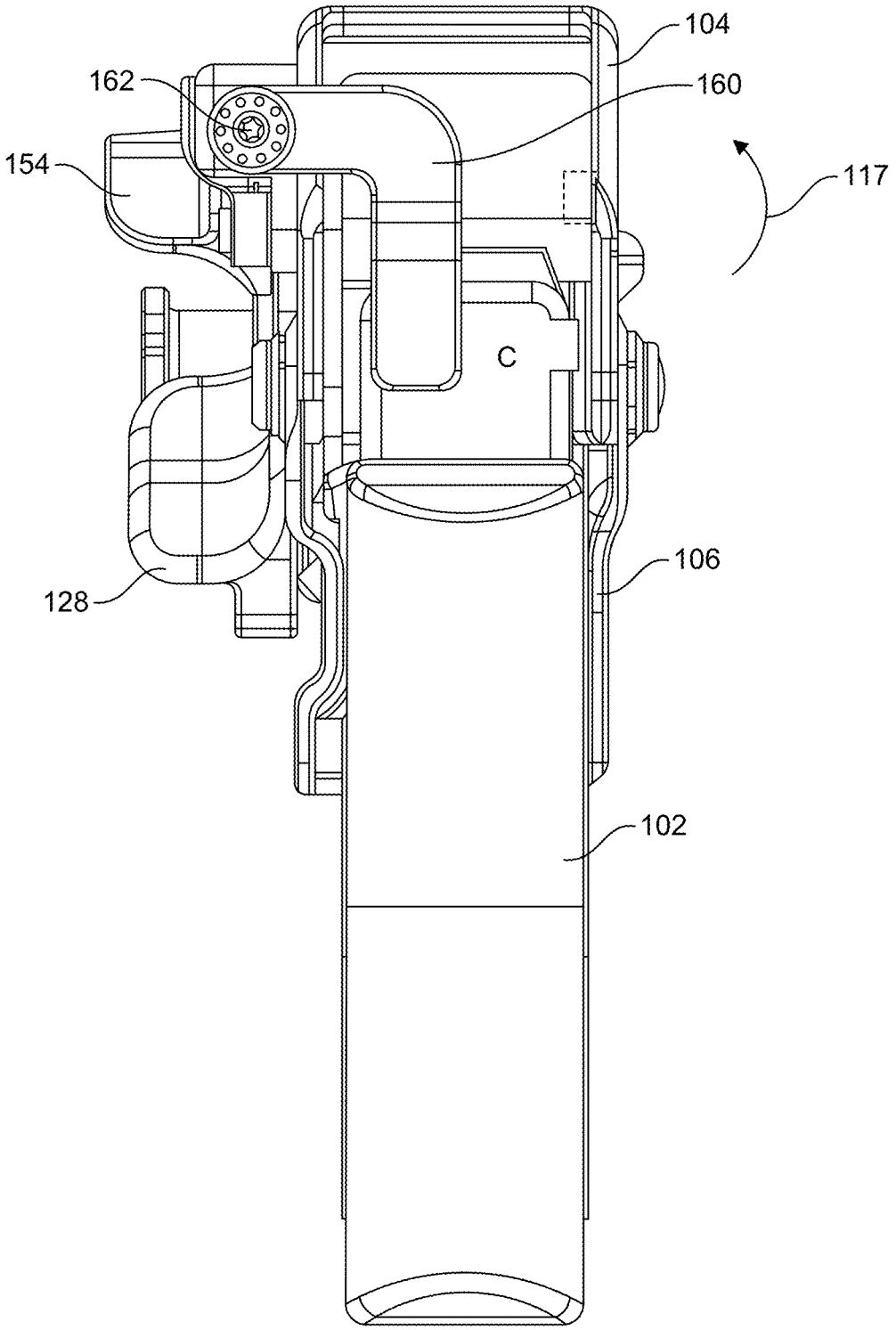
FIG. 9 illustrates a back view of one embodiment of a firearm holster with a secondary lock in the locked position in accordance with the invention.

A secondary thumb pad 154 is attached to the sear lever 156 and is operable to receive a force from a user to pivot the sear lever 156. A helical lock shaft 158 is disposed within the helical lock shaft passage 153 and is operable to rotate and extend from the helical lock shaft passage 153 upon receipt of a force from a user applied to the secondary thumb pad 154. The helical lock shaft 158 defines a helical guide slot 166. The helical guide slot 166 is operable to enable a rotation of the helical lock shaft 158 by engaging a helical guide pin 164 as it extends from the secondary lock body 152. A helical lock bar 160 is secured to the helical lock shaft 158 by a helical lock fastener 162 and is operable to rotate from the locked position C to an unlocked position D in the direction of arrow 117, as illustrated in FIGS. 9-10. A helical guide pin 164 is disposed within the helical guide pin aperture 157 of the secondary lock body 152. The helical guide pin 164 protrudes into the helical guide slot 166 and is operable to retain the helical lock bar 160 in the helical lock shaft passage 153. A helical lock spring 168 is disposed between the secondary lock body 152 and the helical lock shaft 158. The helical lock spring 168 is operable to apply a force to the helical lock shaft 158 to bias the helical lock shaft 158 into the unlocked position C. A helical sear lever spring 170 is disposed between the secondary lock body 152 and the sear lever and is operable to apply a force to the sear lever 156 to bias the sear lever into the locked position C. Upon receipt of an upward force of by a user on the secondary thumb pad 154 in the direction of arrow 121, the sear lever 156 will disengage the helical lock shaft 158. Once the sear lever 156 is disengaged from the helical lock shaft 158, the helical lock shaft 158 will extend outward from the secondary lock body 152 and rotate the helical lock bar 160.

This invention provides several unique advantages over the prior art. First, the configuration allows for a comfortable and quick removal of the firearm 102 from the holster 100 using natural, ergonomic thumb motions. This configuration reduces the amount of training required to train a user to quickly remove the firearm 102 from the holster 100. To remove the firearm 102 from the holster 100, a user will first grip the firearm 102 in a typical shooting grip. The user will then use their thumb to press thumb pad 154 towards the top of the holster 100, thereby rotating the helical lock bar 160 from the locked position C to the unlocked position D. Next, still holding the firearm 102 in the shooting grip, the user will press down on the thumb pad 128 of the triggering arm 116. Pressing the triggering arm 116 down will cause the triggering lever 115 to rotate around the cylindrical shaft portion 129 and drive arm 120 will rotate towards the back of the firearm holster 100. As the drive arm 120 rotates toward the back of the firearm holster 100, it will pull the slider 130 toward the back of the firearm holster 100 from the locked position A to the unlocked position B via the extension arm 134. When the slider 130 is pulled towards the back of the firearm holster 100, the resettable drop lock 146 will pivot up and out of the ejection port 174 of the firearm 102. Once the resettable drop lock 146 is out of the injection port 174, the firearm 102 can be removed from the holster 100 by using enough force required to pull the firearm 102 from the holster 100.

Figure 27:
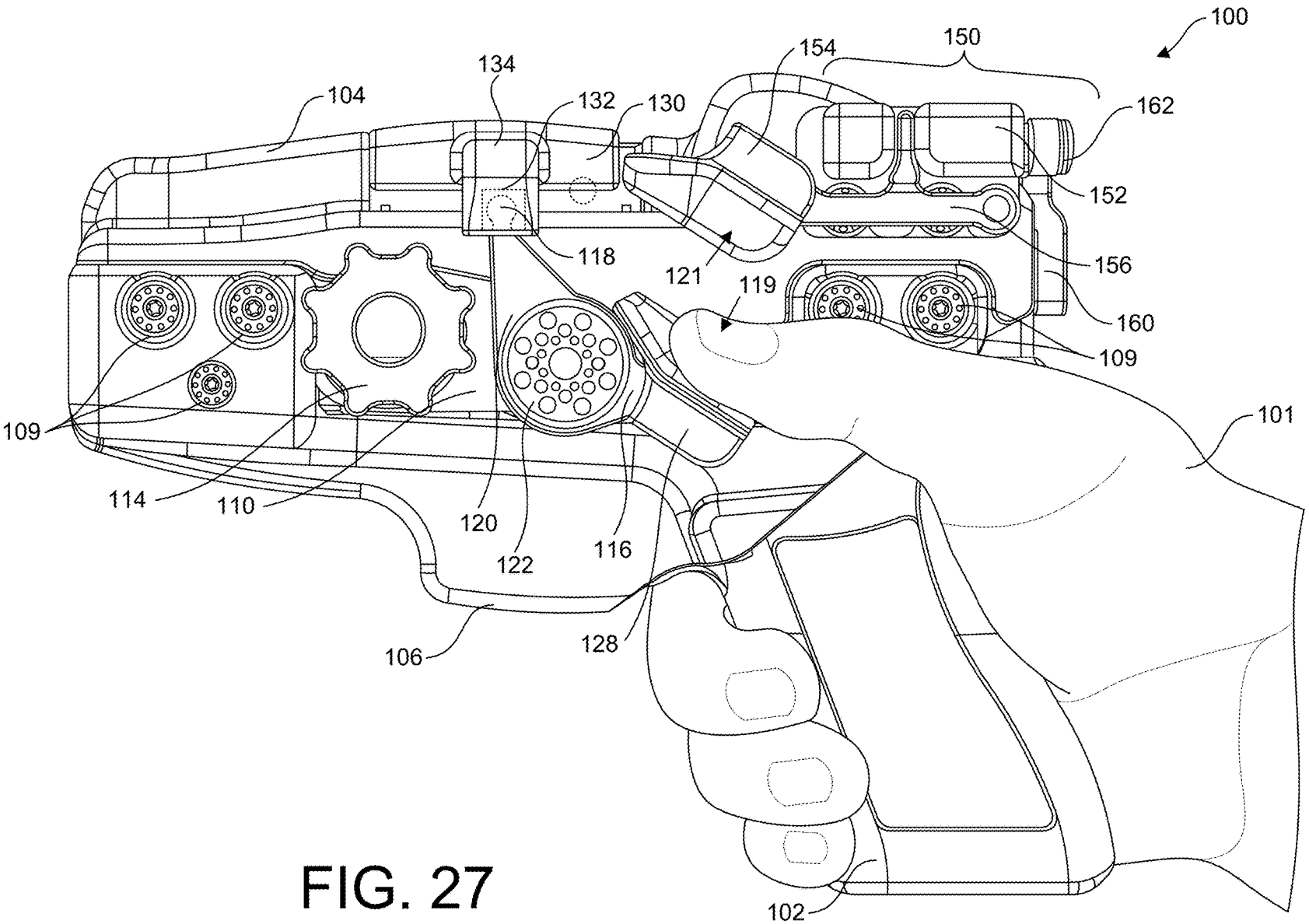
FIG. 27 illustrates a left side view of one embodiment of a firearm holster held by a user in accordance with the invention.
Figure 28:
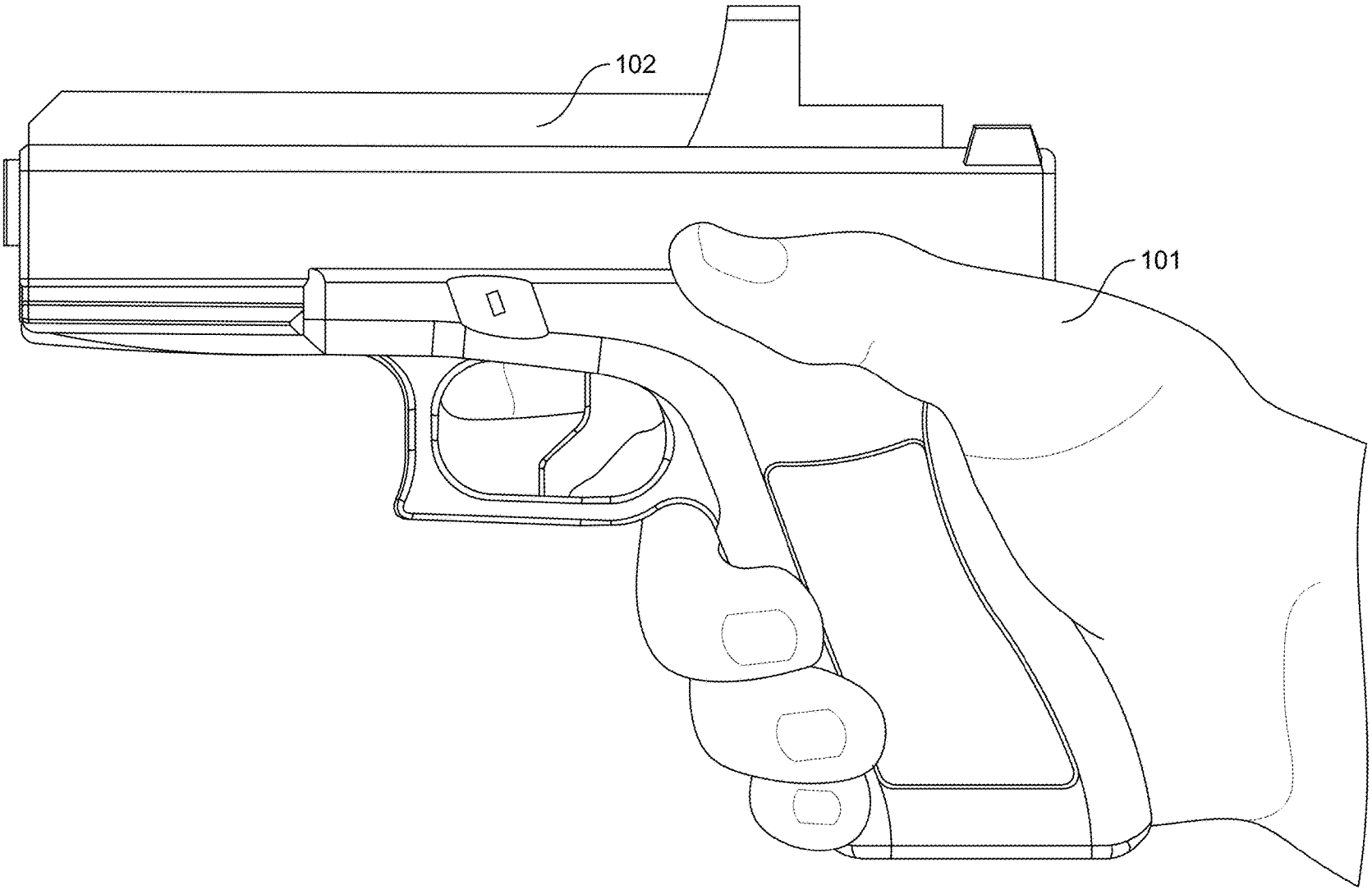
FIG. 28 illustrates a left side view of one embodiment of a firearm holster held by a user in accordance with the invention.
Figure 29:
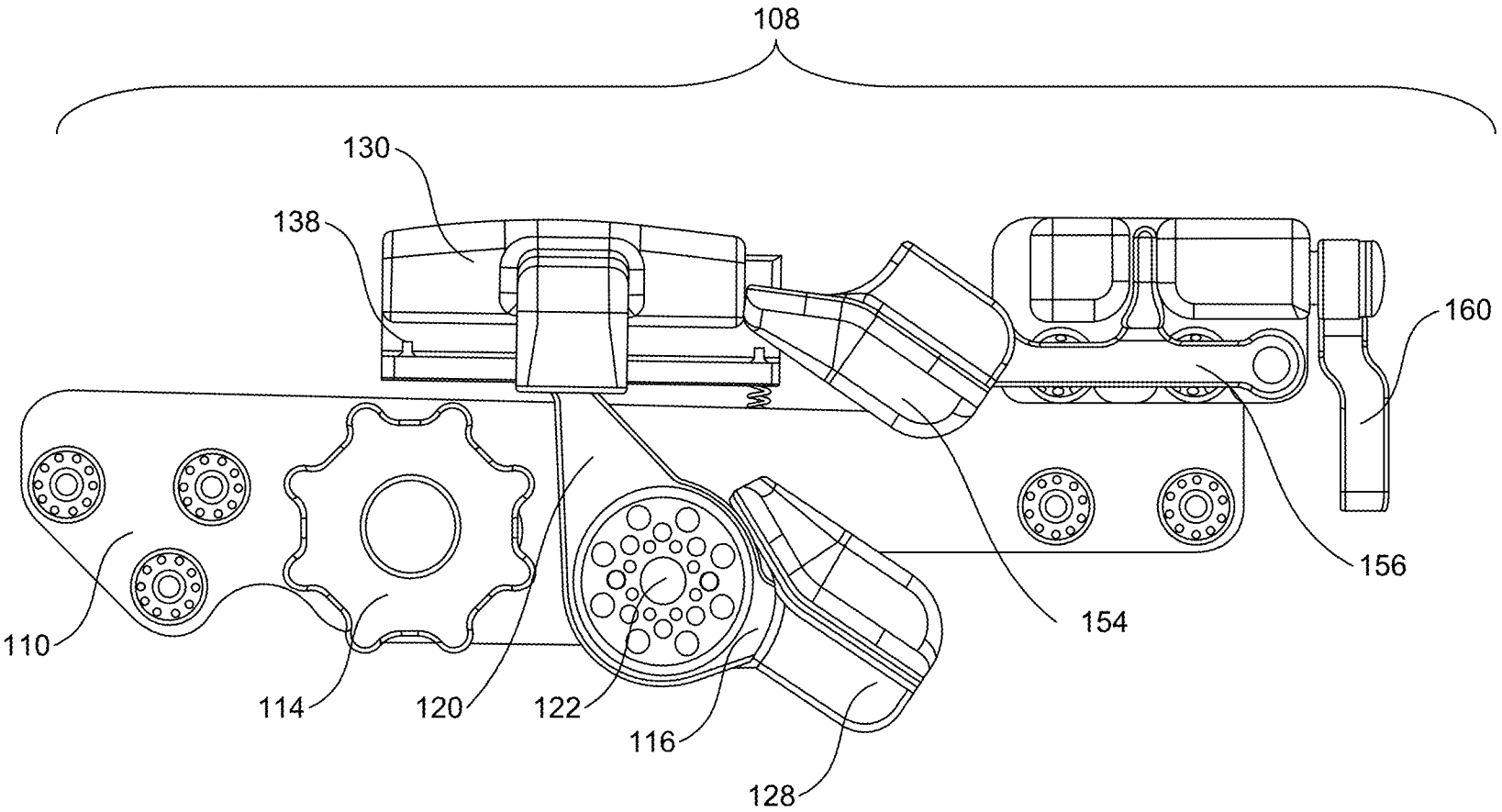
FIG. 29 illustrates a left side view of one embodiment of active locking mechanisms attached to a backbone of a firearm holster in accordance with the invention.
Figure 30:
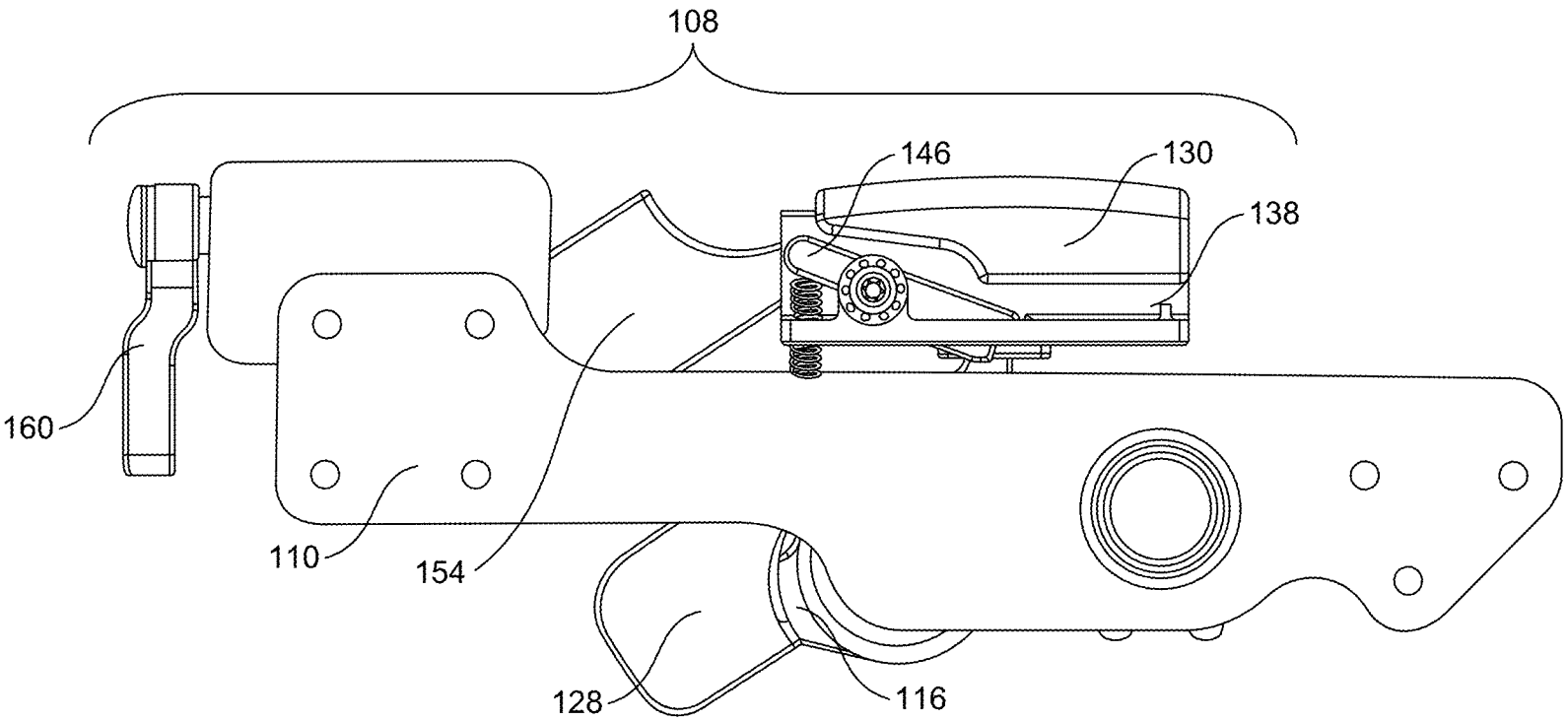
FIG. 30 illustrates a right side view of one embodiment of active locking mechanisms attached to a backbone of a firearm holster in accordance with the invention.
Figure 31:
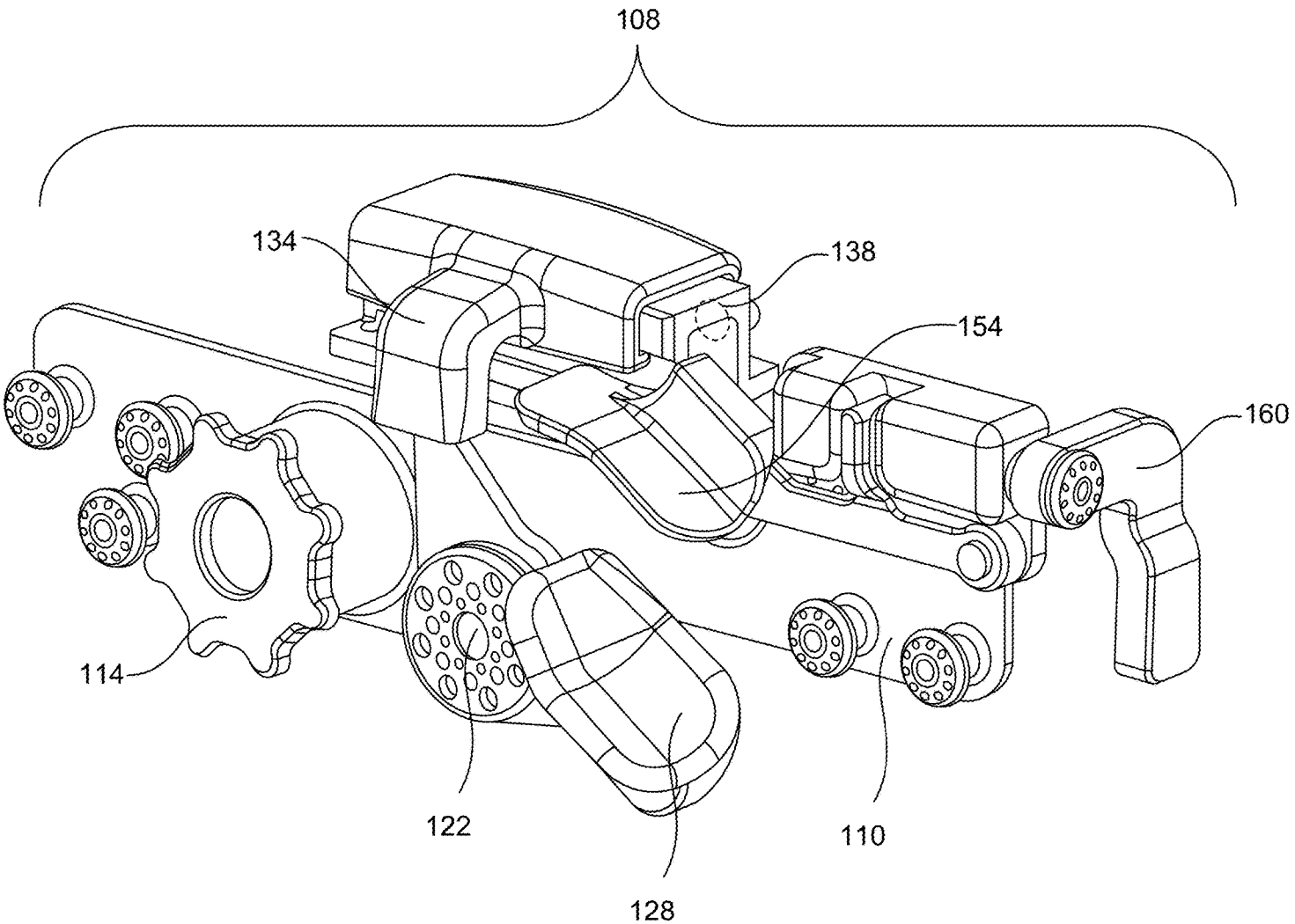
FIG. 31 illustrates a left back perspective view of one embodiment of active locking mechanisms attached to a backbone of a firearm holster in accordance with the invention.
Figure 32:
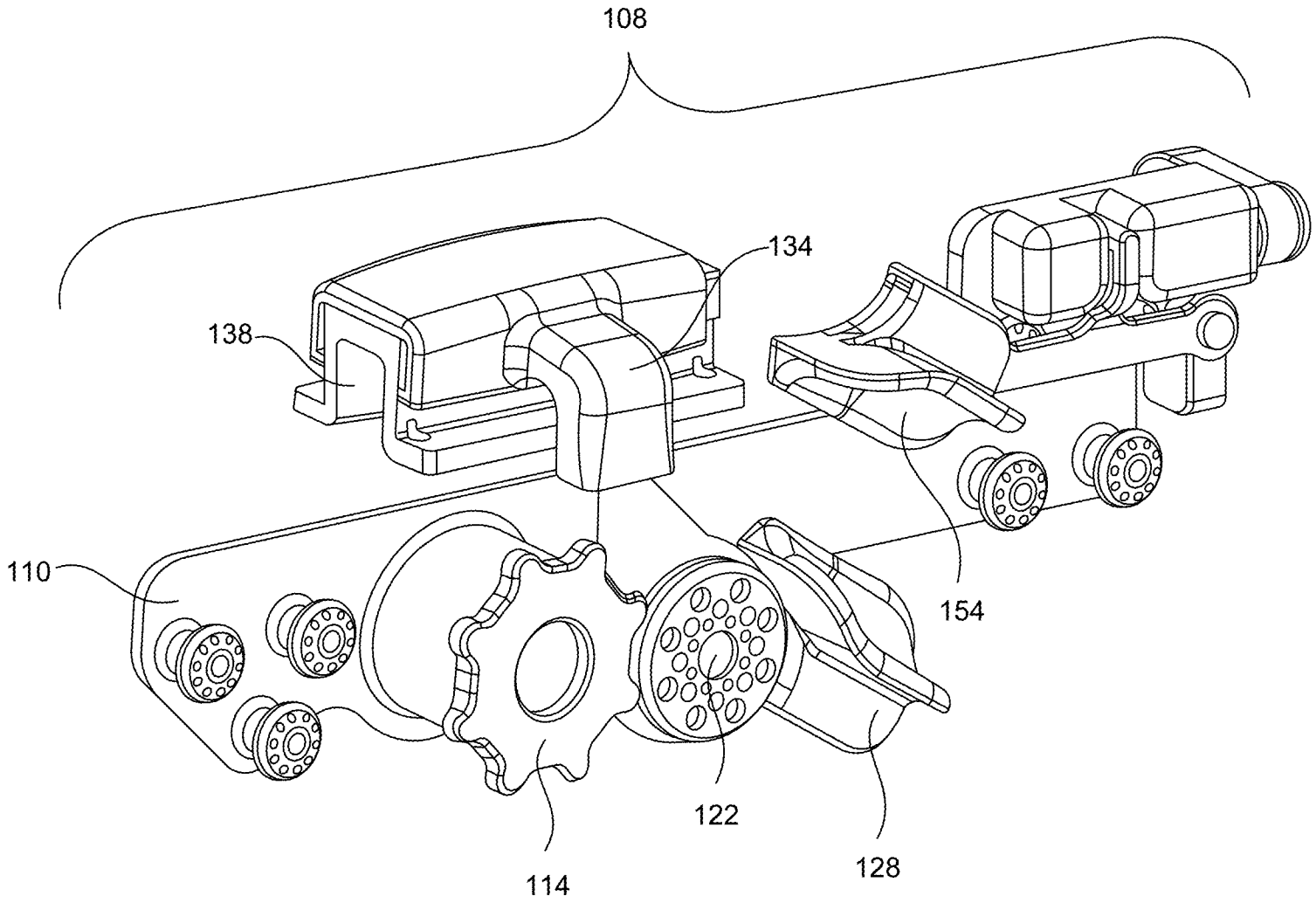
FIG. 32 illustrates a left front perspective view of one embodiment of active locking mechanisms attached to a backbone of a firearm holster in accordance with the invention.
Figure 33:
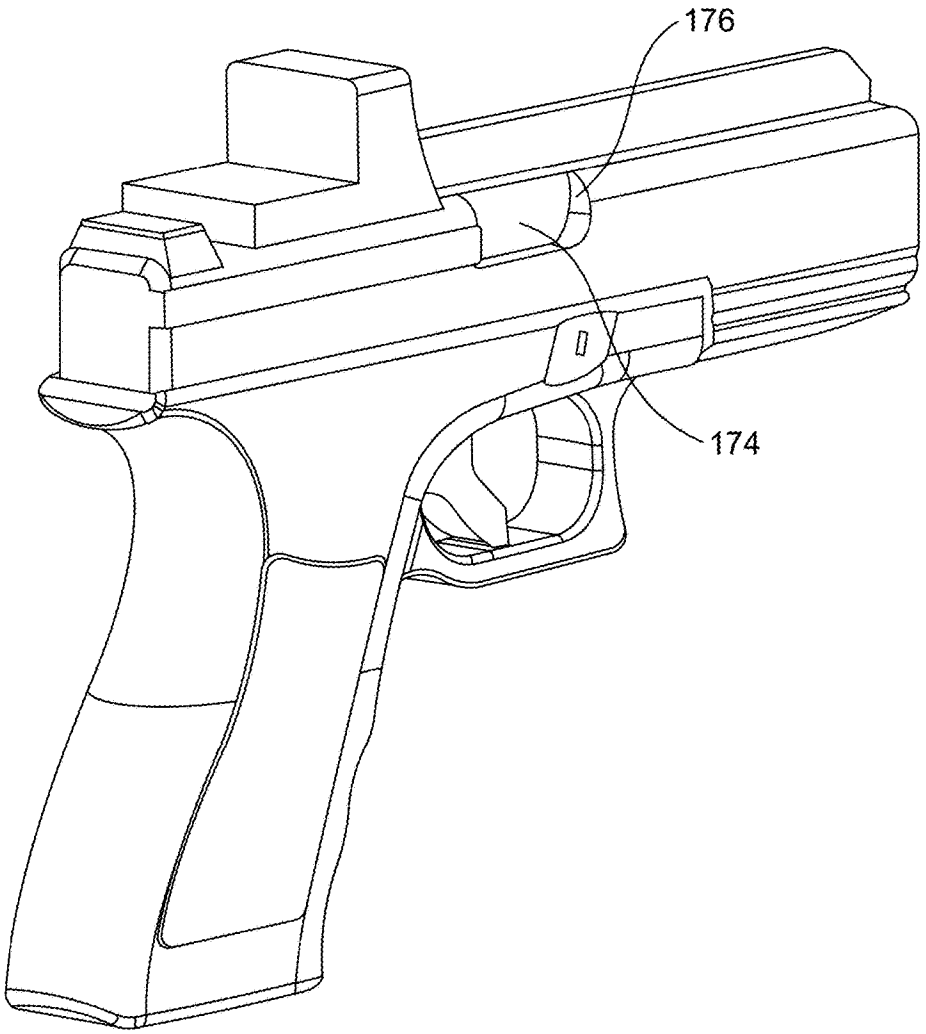
FIG. 33 illustrates a right back perspective view of one embodiment of a firearm having an ejection port.
Figure 34:
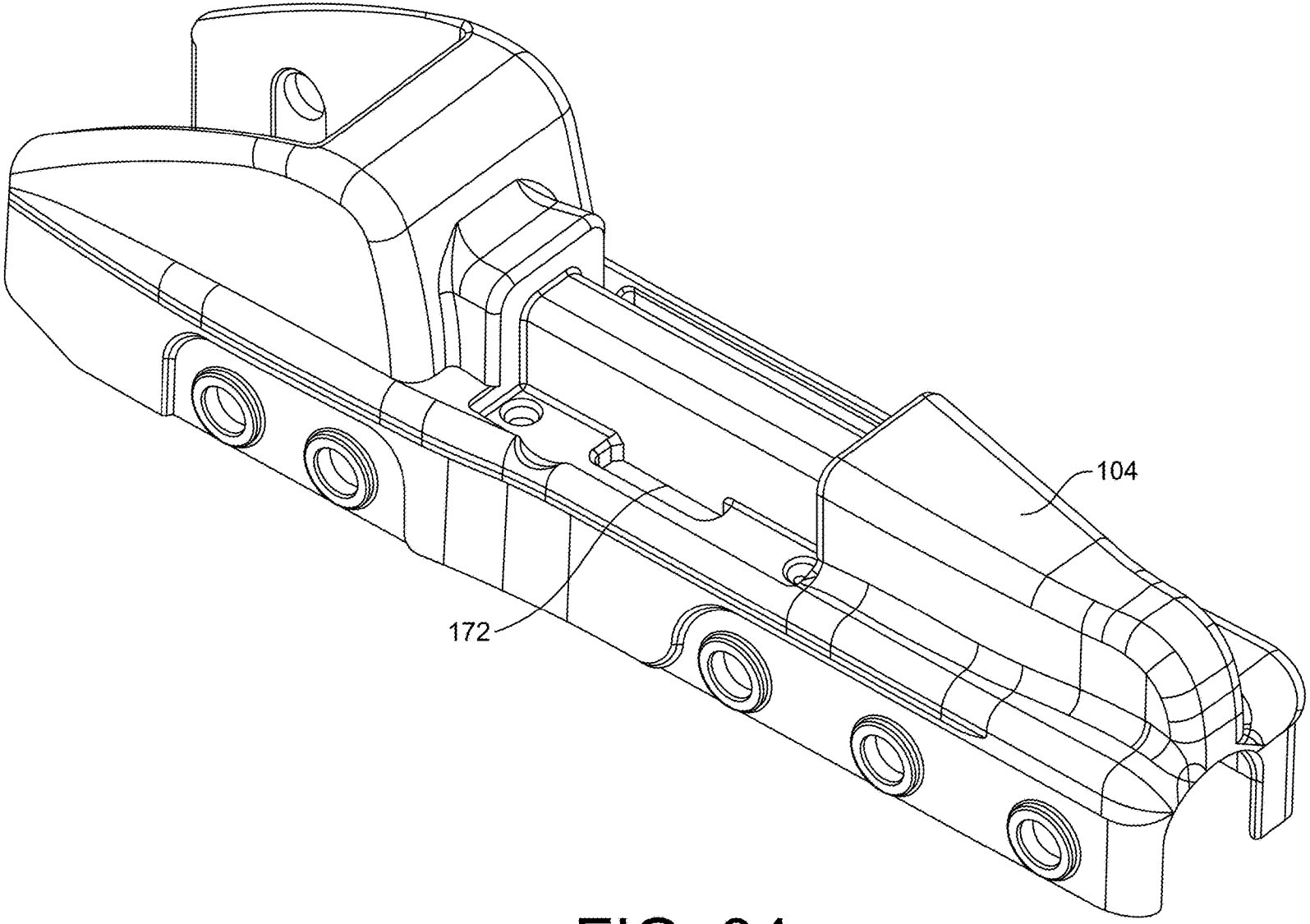
FIG. 34 illustrates a right front perspective view of one embodiment of a top frame in accordance with the invention.

Another novel feature of the invention is that the user is able to maintain a perfect firing grip on the firearm 102 during removal from the holster 100, as illustrated in FIGS. 27 and 28. The user will engage the active locking mechanisms 108 to remove the firearm 102 from the holster 100. The active locking mechanisms 108 are illustrated in FIGS. 29-32. In FIG. 27, the hand 101 of a user grips the firearm 102 in the holster 100. The user will first use their thumb to move secondary thumb pad 154 up in the direction of arrow 121 to unlock the secondary lock assembly 150. The user will then and then press down on the primary thumb pad 128 to release engage the pivotal triggering lever 115, thereby sliding the slider 130 and rotating the resettable drop lock 146 from the ejection port 174. This orientation of the thumb pads 128 and 154 follows the biomechanics of a person's thumb to enable an ergonomic pair of motions to release the firearm 102 from the holster 100. As illustrated in FIG. 28, the same grip of the user's hand 101 is used to hold the gun in the firing position. This shortens the time to adjust the grip of on the firearm 102 after the removal from the holster 100 and requires minimal training to become familiar with unlocking and locking the firearm 102 in the holster 100.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the system (and components of the individual operating components of the system) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A firearm holster operable to retain a firearm, comprising:

a slider base operable for attachment to the firearm holster;

a slider operable to slide between a locked position and an unlocked position along the slider base;

a triggering lever attached to an exterior of a first side of the firearm holster; and a firearm retention mechanism operable to retain a firearm in the holster disposed on a second side of the firearm holster, wherein the second side of the firearm holster is opposite to the first side of the firearm holster, wherein the slider is operable to transfer a force from a user applied to the triggering lever to actuate the firearm retention mechanism.

2. The firearm holster of claim 1, wherein the slider base comprises a rail.

3. The firearm holster of claim 1, wherein the slider base comprises a substantially arched shape.

4. The firearm holster of claim 1, comprising a resettable drop lock operable to retain a firearm in the firearm holster, said resettable drop lock further comprising:

a resettable drop lock body, said resettable drop lock body operable to protrude into an ejection port of a firearm disposed within the firearm holster;

a resettable drop lock mount, said resettable drop lock mount operable to enable the resettable drop lock body to move from a locked position to an unlocked position, said resettable drop lock mount further operable for attachment to the firearm holster; and a spring, said spring operable to spring-bias the resettable drop lock body into the ejection port of a firearm secured within the firearm holster, wherein the slider is operable to selectively pivot the resettable drop lock out of an ejection port of a firearm secured in the firearm holster to enable removal of the firearm from the firearm holster.

5. An adjustable pivotal triggering lever tensioner, comprising:

a triggering lever body, said triggering lever body defining a cylindrical passage operable to receive a cylindrical shaft, said triggering lever body further operable to rotate around said cylindrical shaft from a locked position to an unlocked position upon receipt of a force from a user;

a spring channel defined by the triggering lever body, said spring channel operable to securely enclose a triggering lever spring;

a triggering lever spring disposed within the spring channel of the triggering lever body, said triggering lever spring operable to bias the triggering lever body into the locked position; and a triggering lever spring tension device, said triggering lever spring tension device defining a coupler operable to secure to a trigger lever mount on a firearm holster, said triggering lever spring tension device operable to selectively adjust the tension in the triggering lever spring by selectively rotating and coupling the triggering lever spring tension device relative to the trigger lever mount to contract or elongate the triggering lever spring to adjust the amount of force required by a user to rotate the triggering lever body from the locked position to the unlocked position.

6. The adjustable pivotal triggering lever tensioner of claim 5, further comprising:

a body spring end opening defined by the triggering lever body; and a tensioner spring end opening defined by the triggering lever spring tension device, wherein a first end of the triggering lever spring is disposed within and engaged with the body spring opening and a second end of the triggering lever spring is disposed within and engaged with the tensioner spring opening.

7. The adjustable pivotal triggering lever tensioner of claim 5, wherein the spring is a torsion spring.

8. The adjustable pivotal triggering lever tensioner of claim 5, wherein the coupler defined by the triggering lever spring tension device is a hexagonal female coupler and is operable to couple to a male trigger lever mount on a firearm holster.

9. A backbone operable for use coupling a top frame of a firearm holster to a lower body of the firearm holster, comprising:

a backbone body having a proximal end opposite a distal end, said backbone body operable to extend along a length of a firearm holster;

a proximal frame coupler disposed at the proximal end of the backbone body, said proximal frame coupler operable to couple to a top frame of a firearm holster and a lower body of a firearm holster;

a distal frame coupler disposed at the distal end of the backbone body, said distal frame coupler operable to couple to a top frame of a firearm holster and a lower body of a firearm holster;

a triggering lever mount attached to the backbone body, said triggering lever mount operable to receive and secure a triggering lever; and a coupler defined by the triggering lever mount, said coupler operable to receive a coupler from a triggering lever spring tension device.

10. The backbone of claim 9, wherein the coupler is hexagonal.

11. A firearm holster operable to retain a firearm, comprising:

a triggering lever positioned on an exterior of the firearm holster;

a firearm retention mechanism operable to be disposed on a back of the firearm holster to retain a firearm in the firearm holster;

a secondary lock body defining a lock shaft passage;

a lock shaft disposed within the lock shaft passage, said lock shaft operable to rotate and extend from the lock shaft passage; and a locking release mechanism operable to actuate the firearm retention mechanism, wherein the triggering lever is operable for actuating the locking release mechanism to rotate the firearm retention mechanism about an axis parallel to said firearm from a locked position to an unlocked position.

12. The firearm holster of claim 11, wherein the locking release mechanism is a lock bar attached to the lock shaft, said lock bar operable to rotate from a locked position to an unlocked position, wherein the lock bar is operable to retain a firearm in a firearm holster in the locked position, and wherein the lock bar is operable to enable removal of a firearm from a firearm holster in the unlocked position.

13. The firearm holster of claim 11, further comprising a sear lever channel defined by the secondary lock body, said sear lever channel operable to receive a sear lever pivotally attached to the secondary lock body.

14. The firearm holster of claim 11, further comprising a guide slot defined by the lock shaft, said guide slot operable to receive a guide pin, said guide slot further operable to enable a rotation of the lock shaft when engaging a guide pin as the lock shaft rotates and extends from the lock passage.

15. The firearm holster of claim 14, further comprising:

a lock guide pin aperture defined by the secondary lock body; and a guide pin disposed within the guide pin aperture of the secondary lock body, said guide pin protruding into the guide slot defined by the lock shaft, said helical guide pin operable to retain the helical lock bar in the helical lock shaft passage.

16. The firearm holster of claim 11, further comprising a sear lever pivotally attached to the secondary lock body, said sear lever operable to pivot from a locked position to an unlocked position upon receipt of a force from a user, said sear lever operable to engage and retain a lock bar.

17. The firearm holster of claim 16, further comprising a sear lever spring disposed between the secondary lock body and the sear lever, said sear lever spring operable to bias the sear lever into a locked position.

18. The firearm holster of claim 11, a lock shaft spring disposed between the secondary lock body and the lock shaft, said lock spring operable to apply a force to the lock shaft to bias the lock shaft into an unlocked position.

* * * * *